US012290119B2

(12) United States Patent
Ichigaya

(10) Patent No.: US 12,290,119 B2
(45) Date of Patent: May 6, 2025

(54) OPENING SECTION ADJUSTMENT MECHANISM, GARMENT BODY OF FAN-EQUIPPED GARMENT, AND FAN-EQUIPPED GARMENT

(71) Applicant: SFT LABORATORY CO., LTD., Tokyo (JP)

(72) Inventor: Hiroshi Ichigaya, Tokyo (JP)

(73) Assignee: SFT LABORATORY CO., LTD., Tokyo (JP)

( * ) Notice: Subject to any disclaimer, the term of this patent is extended or adjusted under 35 U.S.C. 154(b) by 57 days.

(21) Appl. No.: 17/436,867

(22) PCT Filed: Mar. 4, 2020

(86) PCT No.: PCT/JP2020/009060

§ 371 (c)(1),
(2) Date: Sep. 7, 2021

(87) PCT Pub. No.: WO2020/184321

PCT Pub. Date: Sep. 17, 2020

(65) Prior Publication Data

US 2022/0132959 A1 May 5, 2022

(30) Foreign Application Priority Data

Mar. 8, 2019 (JP) ..... 2019-042760

(51) Int. Cl.
*A41D 27/28* (2006.01)
*A41D 13/002* (2006.01)

(52) U.S. Cl.
CPC ..... *A41D 27/285* (2013.01); *A41D 13/0025* (2013.01)

(58) Field of Classification Search
CPC ..... A41D 27/285; A41D 13/0025; A41D 2300/33; A41D 13/0007; A41D 2300/30
See application file for complete search history.

(56) References Cited

U.S. PATENT DOCUMENTS 179,170 A * 6/1876 Eager ..... A41F 9/02 24/134 P
181,155 A * 8/1876 Eager ..... A41F 9/02 2/237

(Continued)

FOREIGN PATENT DOCUMENTS

JP 3198778 U 7/2015
JP 2017014644 A 1/2017

(Continued)

OTHER PUBLICATIONS

International Search Report (ISR) (and English translation thereof) dated Jun. 2, 2020 issued in International Application No. PCT/JP2020/009060.

(Continued)

*Primary Examiner* — Alissa L Hoey
(74) *Attorney, Agent, or Firm* — Holtz, Holtz & Volek PC

(57) ABSTRACT

An opening section adjustment mechanism adjusts an opening area of an opening section through which a rope is passed. The opening section adjustment mechanism includes an opening creation mechanism that leaves an opening section around the rope passed through the opening section even when the opening area of the opening section is adjusted to the minimum.

6 Claims, 9 Drawing Sheets

(56) References Cited

U.S. PATENT DOCUMENTS 597,395 A * 1/1898 DeKay ..... B65D 33/28 383/92
885,933 A * 4/1908 Lindy ..... A41F 11/16 2/311
1,825,271 A * 9/1931 Karberg ..... A41F 9/025 2/400
1,902,116 A * 3/1933 Castlen ..... A41F 9/025 2/237
1,951,450 A * 3/1934 Sochel ..... A41F 9/025 2/237
2,113,911 A * 4/1938 Bjornson ..... A41D 3/02 D2/756
2,443,447 A * 6/1948 Falcon ..... A41D 1/02 2/93
2,474,165 A * 6/1949 Roberts ..... A45D 20/44 34/99
2,492,097 A * 12/1949 Katz ..... A41D 1/04 2/76
2,581,366 A * 1/1952 De Grazia ..... A42B 1/045 2/84
2,994,091 A * 8/1961 Aftergood, Jr. ..... A41F 9/025 2/243.1
3,397,406 A * 8/1968 Leach ..... A41F 1/00 2/96
3,887,968 A * 6/1975 Lynam ..... D04D 9/04 428/101
4,864,695 A * 9/1989 Gold ..... A45C 13/1046 24/713.2
4,979,833 A * 12/1990 Cook ..... A45C 3/00 383/117
5,118,201 A * 6/1992 Cook ..... B65D 31/04 383/74
5,339,466 A * 8/1994 McMullen ..... A41D 13/05 2/202
5,946,724 A * 9/1999 Erickson ..... A41D 3/00 2/93
6,018,830 A * 2/2000 Howe ..... A47G 9/086 5/413 R
6,041,441 A * 3/2000 Counts ..... A41D 13/0575 450/150
6,085,695 A * 7/2000 Miller ..... A01K 27/006 224/604
6,298,493 B1 * 10/2001 Ambroise ..... A45D 44/12 2/209
6,317,894 B1 * 11/2001 Blechman ..... A41D 15/002 2/125
6,339,845 B1 * 1/2002 Burns ..... A41D 27/285 2/243.1
6,374,418 B1 * 4/2002 Rindle ..... A42B 1/048 2/202
6,467,096 B1 * 10/2002 Coluccio ..... A42B 1/22 2/195.2
6,618,863 B2 * 9/2003 Blechman ..... A41F 9/025 2/311
6,654,963 B2 * 12/2003 Fayle ..... A41D 3/00 2/84
6,859,944 B2 * 3/2005 Kim ..... A41D 1/06 2/237
6,948,190 B2 * 9/2005 McGreggor ..... A42B 1/049 2/202
7,921,470 B2 * 4/2011 Doran ..... A41D 27/10 2/59
8,061,366 B2 * 11/2011 Britton ..... A45D 8/36 132/273
D720,120 S * 12/2014 Simmonds ..... D2/885
9,259,039 B2 * 2/2016 Okies ..... A41F 9/02
9,468,238 B2 * 10/2016 Keathley ..... A41B 1/08
10,051,907 B2 * 8/2018 Dammann ..... A42B 1/12
10,070,674 B1 * 9/2018 Beckers ..... A41D 27/00
10,517,339 B1 * 12/2019 Baxter ..... A41D 20/00
11,330,885 B2 * 5/2022 Walker ..... A42B 1/041
D957,735 S * 7/2022 Walker ..... D28/12
11,388,937 B2 * 7/2022 Nachawati ..... A63B 71/10
2005/0108804 A1 * 5/2005 Bush ..... A41D 3/00 2/84
2007/0271939 A1 11/2007 Ichigaya
2010/0186146 A1 * 7/2010 Askew ..... A45D 44/12 2/209
2017/0027262 A1 * 2/2017 Palmer ..... A42B 1/22
2017/0042267 A1 * 2/2017 Guice ..... A42B 1/12
2018/0007995 A1 * 1/2018 Morales ..... A41D 1/04
2018/0132551 A1 * 5/2018 Holder, III ..... A41D 15/00
2018/0249804 A1 * 9/2018 Walker ..... A45D 20/18
2021/0204622 A1 * 7/2021 Ichigaya ..... A41D 3/04

FOREIGN PATENT DOCUMENTS

JP 3212889 U 9/2017
JP 3216874 U 6/2018
JP 2018119230 A 8/2018
WO 2005063065 A1 7/2005

OTHER PUBLICATIONS

Written Opinion dated Jun. 2, 2020 issued in International Application No. PCT/JP2020/009060.
International Preliminary Report on Patentability (IPRP) (and English language translation thereof) dated Aug. 25, 2021, issued in International Application No. PCT/JP2020/009060.
Chinese Office Action (and an English language translation thereof) dated Mar. 2, 2024, issued in counterpart Chinese Application No. 202080019002.9.
Chinese Office Action (and an English language translation thereof) dated Jul. 31, 2024, issued in counterpart Chinese Application No. 202080019002.9.

* cited by examiner

OPENING SECTION ADJUSTMENT MECHANISM, GARMENT BODY OF FAN-EQUIPPED GARMENT, AND FAN-EQUIPPED GARMENT

TECHNICAL FIELD

The present invention relates to an opening section adjustment mechanism, a garment body of a fan-equipped garment, and a fan-equipped garment.

BACKGROUND ART

In recent years, a fan-equipped garment that cools a body has been put into practical use and is rapidly becoming widespread.

A conventional fan-equipped garment includes:

a garment body made of a material with low breathability;

two fans attached to a lower part of the garment body on a back side;

a power source that supplies power to the two fans; and a power cable that electrically connects the power source with the two fans.

When the fans are activated, the fans take a large amount of air into the garment body. Pressure of the air taken in automatically creates an air flow passage between the garment body and a wearer's body. The taken-in air circulates through the created air flow passage along a surface of the wearer's body or underwear. For example, air is discharged to the outside through air outlets formed in opening sections of a collar and sleeves.

The taken-in air evaporates sweat on the wearer's body while flowing through the air flow passage between the garment body and the wearer's body or underwear. The heat of vaporization generated by evaporating sweat cools the body (see, for example, Patent Document 1).

When such a fan-equipped garment is worn in work in high places, the fan-equipped garment is expected to be used together with a full harness type safety belt to ensure safety. If the full harness type safety belt is attached to the outside of the garment body of the fan-equipped garment, the garment body is tightened from the outside and the air flow passage is closed. Therefore, to use the air-conditioned garment and the full harness type safety belt at the same time, it is necessary to wear the fan-equipped garment over the full harness type safety belt.

To use the fan-equipped garment together with the full harness type safety belt, the garment body of the fan-equipped garment required to be provided with a rope penetration unit. A rope provided in the full harness safety belt passes through the rope penetration unit.

The rope provided in the full harness type safety belt usually includes a hook for hooking on a fixed object at an end of the rope. The end is opposite to an end connected to the full harness type safety belt. The rope penetration unit must have an opening section which is large enough to allow the hook to pass through the rope penetration unit.

On the other hand, when a fan-equipped garment is used, if the opening section which is large enough to allow the hook to pass through the rope penetration unit remains, air leakage from the opening section becomes too large. Insufficient amount of air is discharged to the outside through the opening sections in the collar and sleeves. Cooling effect is reduced at an upper part, sleeves, etc. of the fan-equipped garment.

In view of this, a rope penetration unit of a known fan-equipped garment includes an air seal (see, for example, Patent Literature 2). The air seal closes the opening sections while the fan-equipped garment is used.

CITATION LIST

Patent Literature

Patent Literature 1: WO 2005/063065 A

Patent Literature 2: JP 2017-14644 A.

SUMMARY OF INVENTION

Technical Problem

As described above, if an opening section which is large enough to allow a hook to pass through the opening section remains in the rope penetration unit, it is not preferable for improving cooling effect of the fan-equipped garment. There, the opening section is reduced as compared with the state in which the hook can be passed. The opening section is not completely closed and is slightly open. Such an opening section can also be utilized as an air outlet for discharging air taken in by the fans.

It prevents shortage of air discharged from opening sections in a collar and sleeves. It facilitates flow of air around the rope penetration unit. It is expected that cooling effect will, be improved.

According to the air seal described in Patent Literature 2, when a wearer adjusts a length of a cord passed through a cord loop with a cord stopper, the wearer can keep the opening section not completely closed. The wearer adjusts the length of the cord appropriately so that a slight opening section remains around the rope. The opening section can be utilized as an air outlet.

However the air seal aims to completely close the opening section. Asking wearers to make the above adjustment every time they put on the garment increases time and effort of wearing. It is not practical.

An object of the present invention is to provide an opening section adjustment mechanism, a garment body of a fan-equipped garment, and a fan-equipped garment which facilitate utilization of an opening through which a rope is passed as an air outlet.

Solution to Problem

According to one aspect of the invention, an opening section adjustment mechanism is provided that adjusts an opening area of an opening section through which a rope is passed. The opening section adjustment mechanism includes an opening creation mechanism that leaves an opening section around the rope passed through the opening section even when the opening area of the opening section is adjusted to the minimum.

The opening section adjustment mechanism may further include a contraction unit that contracts a rim of the opening section, wherein the opening creation mechanism includes a contraction control mechanism that suppresses contraction by the contraction unit, and the contraction control mechanism keeps an inner circumference of the opening section larger than an outer circumference of a portion of the rope which is passed through the opening section even when the rim of the opening section is most contracted by the contraction unit.

The contraction unit may include a cord loop which extends along the rim of the opening section and which has a gap that communicates with an outside at an outlet; and a cord passed through the cord loop such that a part of the cord is exposed from the outlet, wherein the contraction control mechanism suppresses contraction of the cord loop.

The contraction unit may further include a joining part at which the cord loop and the cord are joined, wherein the joining part functions as the contraction control mechanism.

The contraction unit may include the joining parts at at least two positions, and the joining parts may suppress contraction of a portion between the joining parts where the outlet is not formed.

The contraction unit may include, along the rim of the opening section, a passage where the cord is passed through the cord loop, and a non-passage where the cord is not passed through the cord loop, wherein the non-passage functions as the contraction control mechanism.

The cord loop may include at least two outlets formed with a predetermined interval, the non-passage being formed between the outlets.

The outlets may include an outer outlet formed on an outer peripheral side of the cord loop.

The outlets may include the outer outlet, and inner outlets formed at least at two positions on an inner peripheral side of the cord loop. The passage can be formed between the outer outlet and the inner outlet, and the non-passage can be formed between the inner outlets.

The outlets may include inner outlets formed at at least four positions on an inner peripheral side of the cord loop. The passages and the non-passages can be alternately arranged such that the passage and the non-passage are switched at the inner outlets.

The opening section adjustment mechanism may further include a reinforcement member that has a predetermined length along the rim of the opening section, wherein the reinforcement member functions as the contraction control mechanism.

The opening section adjustment mechanism may further include a fixing unit that fixes the contraction unit in a contracted state.

The contraction unit may include a rubber cord that extends along the rim of the opening section, and a portion of the rim of the opening section which is not provided with the rubber cord can function as the contraction control mechanism.

The contraction unit may also include a cord loop which extends along the rim of the opening section and which has a gap through which the rubber cord is passed, wherein the rubber cord is joined with the cord loop while being passed through the cord loop.

The opening section adjustment mechanism may further include, along the rim of the opening section, a first connection which has a predetermined length along the rim of the opening section, and a second connection which has a predetermined length along the rim of the opening section and which can be detachably attached to the first connection, wherein a portion of the rim of the opening section which is not provided with the first connection or the second connection functions as the contraction control mechanism.

According to another aspect of the invention, a garment body is provided for a fan-equipped garment which is formed in a shape to cover at least a trunk of a wearer and which is made of garment cloth that is not breathable or has sufficient breathability to be inflated by a ventilator that introduces air. The garment body includes a mount hole for mounting the ventilator, and a rope penetration unit through which a rope penetrates from an inside to an outside of the garment body of the fan-equipped garment, wherein the rope penetration unit includes the opening section adjustment mechanism described above.

According to a further aspect of the invention, a fan-equipped garment includes the garment body described above, the ventilator that introduces air inside the garment body of the fan-equipped garment; and a power source that supplies power to the ventilator.

Advantageous Effects of Invention

The present invention provides an opening section adjustment mechanism, a garment body of a fan-equipped garment, and a fan-equipped garment which facilitate utilization of an opening through which a rope is passed as an air outlet.

DESCRIPTION OF EMBODIMENTS

Hereinafter, a fan-equipped garment according to embodiments of the present invention will be described with reference to FIGS. 1 to 18. A scope of the claims of the present invention is not limited to examples shown in figures. In the following, the front, back, top, bottom, right and left correspond to those of a wearer of the fan-equipped garment, respectively.

First Embodiment

The fan-equipped garment 100 according to a first embodiment will be described with reference to FIGS. 1 to 4.

Configuration of Embodiment

Figure 1:
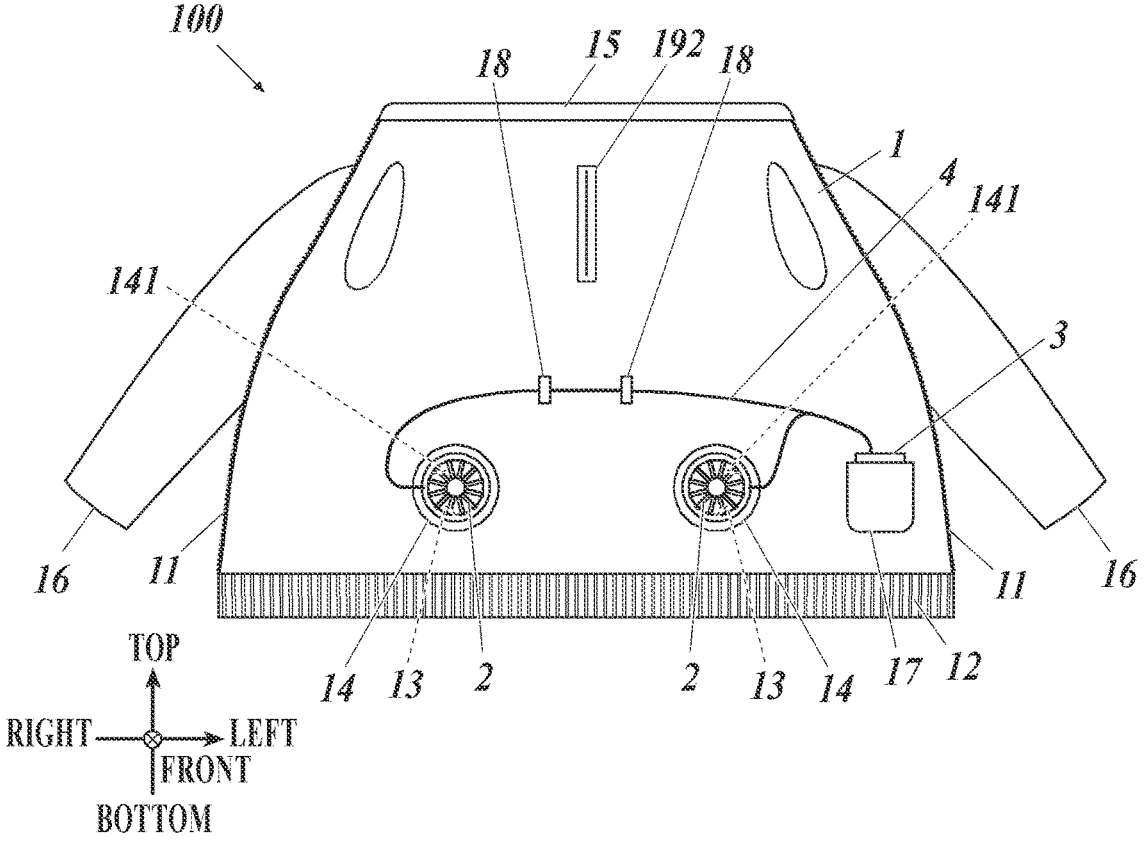
FIG. 1 is a front view of a fan-equipped garment according to the first embodiment. A first fastener is open. A state in which a rope passage is pulled out to an outer side of a garment body is shown. Other drawings show the same state.

As shown in FIG. 1, the fan-equipped garment 100 according to the embodiment includes:

a garment body 1;

fans 2 that introduce air into the garment body 1;

a power source 3 that supplies power to the fans 2; and a connection cable 4 that connects the power source 3 with the fans 2.

The fan-equipped garment 100 circulates air taken into the garment body 1 by the fans 2 along a surface of a body or underwear of a wearer. It evaporates sweat on the body. Heat of vaporization generated by evaporation cools the body.

Garment Body

Figure 2:
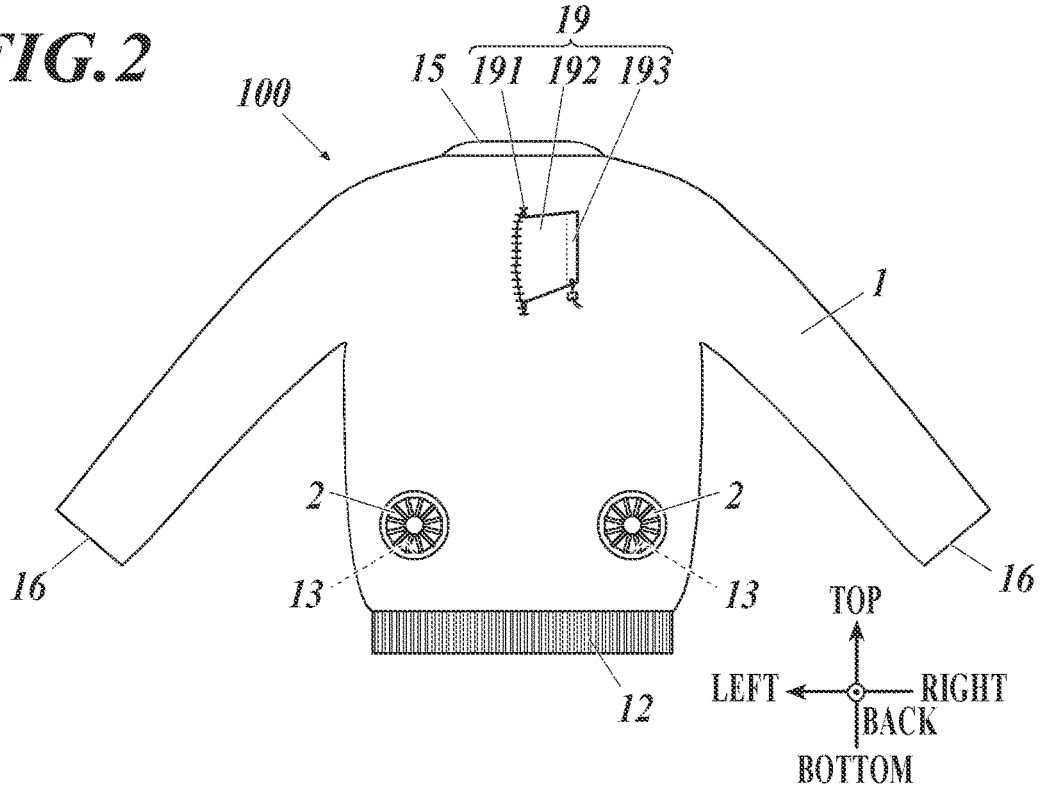
FIG. 2 is a rear view of the fan-equipped garment according to the first embodiment. The first fastener is closed.

As shown in FIGS. 1 to 2, the garment body 1 is made of garment cloth and is formed in a shape that covers a wearer's trunk and arms. The garment cloth is not breathable or has sufficient breathability to be inflated by the fans 2 that introduce air. In FIGS. 1 to 2, the garment body 1 is formed in a shape of a blouson. The shape of the garment body 1 is not limited to this. For example, the garment body 1 may be formed in a shape of a vest that covers only a trunk of a wearer.

As shown in FIGS. 1 to 2, the garment body 1 includes a first fastener 11, an air seal 12, fan mount holes 13, hole reinforcement members 14, a collar air outlet 15, sleeve air outlets 16, a power source holder 17, the cable holder 18, and a rope penetration unit 19. Air taken in by the fans 2 through the fan mount holes 13 is discharged from the collar air outlet 15 and the sleeve air outlets 16.

First Fastener

The first fastener 11 is used to open and close a front part of the garment body 1 when the fan-equipped garment 100 is put on. As shown in FIGS. 1, the first fastener 11 is mounted on each edges of a divided portion of a front part of the garment body 1. The edges of the divided portion are able to be connected and separated. For example, a common zipper is used as the fastener 11.

Air Seal

As shown in FIGS. 1 to 2, the air seal 12 is at a lower part of the garment body 1, and prevents air in a space between the garment body 1 and a wearer's body from leaking outside through a hem of the garment body 1. The air seal 12 is constituted by, for example, an elastic member such as a rubber cord. The elastic member is wound around a wearer's body near a bottom of the garment body 1. When the fan-equipped garment 100 is worn, the hem of the garment body 1 is narrowed by the air seal 12 to come into close contact with the wearer's body. It prevents air from leaking out through the bottom of the garment body 1.

In cases where a very small amount of air flows out through the hem, such as a case where the garment body 1 is formed in a shape in which the hem is tapered, and a case where the hem of the garment body 1 is put in trousers, the air seal 12 may not be provided.

Fan Mount Hole

As shown in FIGS. 1 to 2, the fan mount holes 13 are circular holes formed in the garment, cloth constituting the garment body 1 at positions corresponding to right and left portions of a waist of a wearer. The fan mount hole 13 connects the space between the garment body 1 and a wearer's body with the outside of the garment body 1 while the fan-equipped garment 100 is worn.

The fan 2 is mounted so as to pass through the fan mount hole 13. Air is taken into the garment body 1 from the outside through the fan mount hole 13.

Positions where the fan mount holes 13 are formed are not limited to the above positions. The far mount hole 13 may be for mod on a lateral side, the front side, or the like of the garment body 1. The number of fan mount holes 13 is not limited to two. Less or more than two fan mount holes 13 may be formed. The number of the fans 2 to be mounted corresponds to the number of the fan mount holes 13.

Hole Reinforcement Member

As shown in FIG. 1, the hole reinforcement member 14 is a flat annular member made of, for example, plastic or the like. The hole reinforcement member 14 has hole 141 at the center, the hole 141 having a size substantially the same as that of the fan mount hole 13. The hole reinforcement member 14 is mounted on the inner surface of the garment body 1 so that the hole 141 overlaps the fan mount hole 13. It reinforces the garment body 1 in the area around the fan mount hole 13. It makes it easier to mount the fan 2 in the fan mount hole 13 while it makes if difficult for the attached fan 2 to come off.

The hole reinforcement member 14 can be attached to the garment cloth constituting the garment body 1 in any method, such as sewing or adhesion. A lining that covers the hole reinforcement member 14 may be provided on the inner surface of the garment body 1.

The hole reinforcement member 14 may not be provided, though it makes it difficult to mount the fan 2 and makes it easy for the fan 2 to come off.

Air Outlet

The air outlet is an opening section that discharges air introduced from the fan mount hole 13 by the fan 2 after the air flows along the body or underwear of a wearer. As shown in FIGS. 1 to 2, the collar air outlet 15 is formed at an opening section between a wearer's neck and an edge of a collar of the garment body 1. The sleeve air outlet 16 is formed at an opening section between a wearer's arm and an edge of the sleeve of the garment body 1.

Power Source Holder

As shown in FIG. 1, the power source holder 17 is, for example, a pocket formed on the inner surface of the garment body 1. The power source 3 is put in the power source holder 17. FIG. 1 shows a case where the power source holder 17 is provided on the left side at a lower position of the front part of the garment body 1. The position of the power source holder 17 is not limited to this. The power source holder 17 can be provided at any position on the inner surface of the garment body 1.

The power source holder 17 may not be a pocket. As long as the power source 3 can be attached to the garment body 1, the power source holder 17 may have any configuration. The garment body 1 may not include the power source holder 17. In that case, for example, the power source 3 is attached to a belt or the like of trousers of the wearer W with a clip or the like. The power source 3 is not attached to the garment body 1.

Cable Holder

As shown in FIG. 1, the cable holder 13 holds the connection cable 4 on the inner side of the garment body 1. For example, the cable holder 18 is formed in a shape of a ring having an opening section through which the connection cable 4 passes. The cable holder 13 holds the connection cable 4 by passing the connection cable 4 through the opening section.

As long as the cable holder 18 can hold the connection cable 4 at a predetermined position on the inner side of the garment body 1, the cable holder 16 may have any shape and may be made of any material. For example, like a common belt loop, the cable holder 18 is formed by sewing two upper and lower ends of a cloth that is long in a vertical direction. The position of the cable holder 18 is not limited to the position shown in FIG. 1.

Rope Penetration Unit

The rope penetration unit 19 is a penetration portion for pulling out a rope R of a full harness type safety belt from the inside of the garment body 1 to the outside. A wearer wears the rope R inside the garment body 1.

In the present invention, the "rope" can be any member that connects a main body of the full harness type safety belt to a hook or the like for hooking on a fixed object. The rope may have any specific shape and may be made of any material.

As shown in FIGS. 1 to 2, the rope penetration unit 19 is provided at an upper part of a back part of the garment body 1 at a center in a right-left direction.

Figure 3:
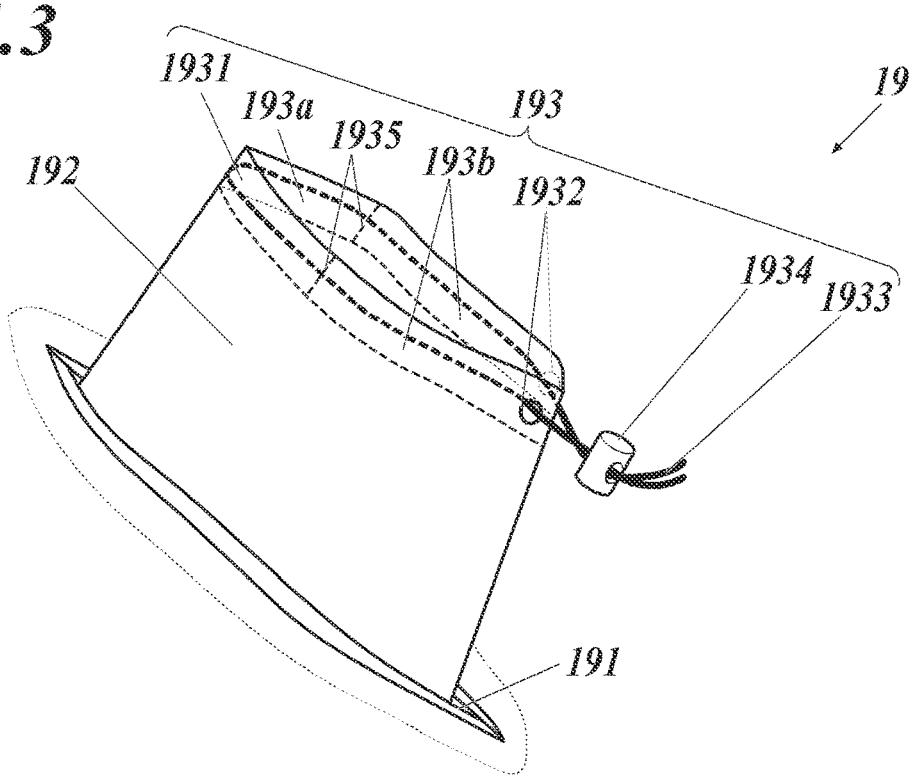
FIG. 3 is a schematic perspective view of a rope penetration unit according to the first embodiment. A contractible portion of an opening section adjustment mechanism is stretched.
Figure 4:
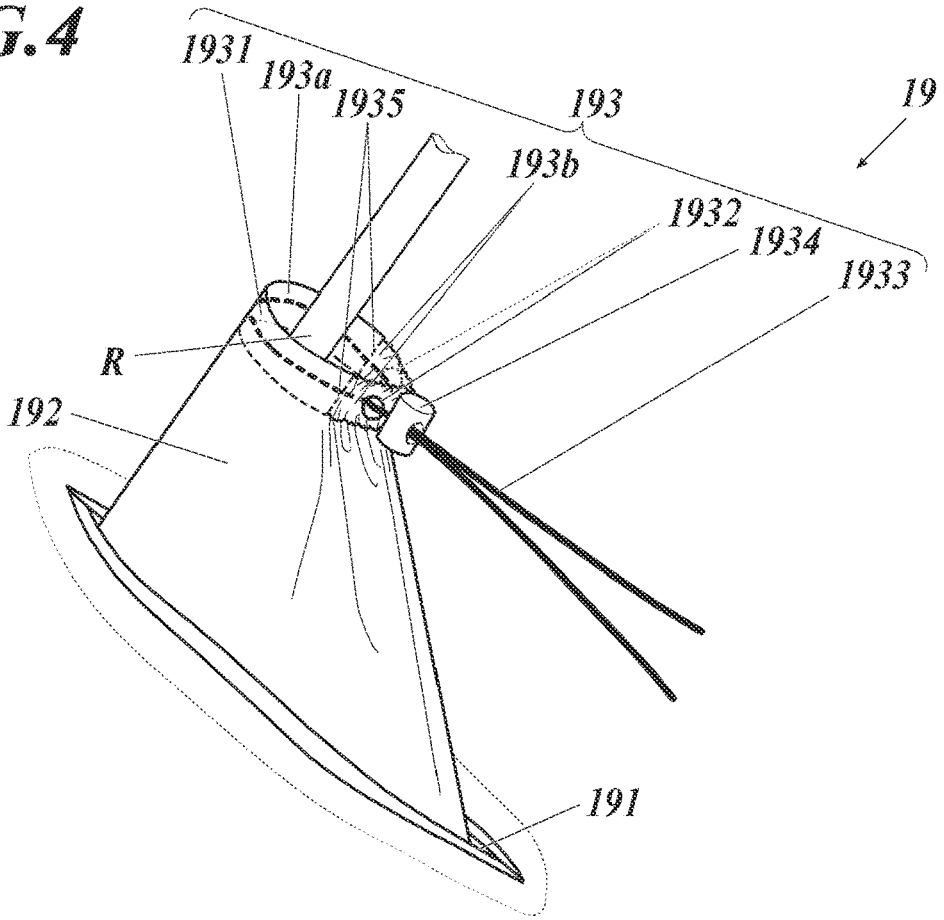
FIG. 4 is a schematic perspective view of the rope penetration unit according to the first embodiment. The contractible portion of the opening section adjustment mechanism is contracted.

As shown in FIGS. 2 to 4, the rope penetration unit 19 includes:

a second fastener 191 which is a closable hole formed in the garment cloth of the garment body 1;

a rope passage 192 which is formed in a tubular shape and which includes an edge joined to an inner surface of the garment cloth of the garment body 1 so as to surround the second fastener 191; and an opening section adjustment mechanism 193 formed at an edge of the rope passage 192 which is opposite to the edge joined to the garment cloth of the garment body 1.

As shown in the figure, in the embodiment, the rope penetration unit 19 is formed on the upper part of the back part of the garment body 1 at the center in the right-left direction. This is because the garment body 1 is worn over the full harness type safety belt including the rope R connected to a back side of a wearer. The position of the rope penetration unit 19 is not limited to this.

For example, the rope penetration unit 19 may be formed on an upper part of the front part of the garment body 1 at the center in the right-left direction. The garment body 1 is worn over the full harness type safety belt including the rope R connected to a front side of a wearer. The rope penetration unit 19 may be provided on both the back part and the front part of the garment body 1.

It makes it possible to wear either of:

the full harness type safety belt with the rope R connected to a back side of a wearer; and the full harness type safety belt with the rope R connected to a front side of a wearer.

Second Fastener

As shown in FIGS. 2 to 4, the second fastener 191 is formed by allowing a vertical slit to be opened and closed, the slit being formed in the garment cloth at the upper part of the back part of the garment body 1. For example, like the first fastener 11, a zipper is used as a means for allowing the second fastener 191 to be opened and closed.

Rope Passage

As shown in FIGS. 1 to 4, the rope passage 192 is formed in a tubular shape. One edge of the rope passage 192 is joined to the inner surface of the garment cloth of the garment body 1 so as to surround the second fastener 191. The other edge of the rope passage 192 is provided with the opening section adjustment mechanism 193.

A foldable sheet which is not breathable or has low breathability is used as a material for the rope passage 192. For example, the same material as the garment cloth of the garment body 1 may be used, or another material such as vinyl may be used.

Since the second fastener 191 and the rope passage 192 have such configurations, the rope passage 192 can be housed inside the garment body 1 when the rope penetration unit 19 is not used. In that case, the rope penetration unit 19 is pushed into the inner side of the garment body 1 via the second fastener 191. The second fastener 191 is closed. To use the rope penetration unit 19, the second fastener 191 is opened, and the rope passage 192 is pulled out.

Opening Section Adjustment Mechanism

As shown in FIGS. 3 to 4, opening section adjustment mechanism 193 includes two outlets 1932 at an edge of the rope passage 192. The edge is opposite to the edge of the rope passage 192 which is connected to the garment cloth of the garment body 1. A substantially annular cord loop 1931 is formed. The cord loop 1931 has a gap through which a cord can be passed. A cord 1933 longer than an outer circumference of the cord loop 1931 is passed through the cord loop 1931. Cord stoppers 1934 are provided at two ends of the cord. 1933 which protrude outward from the outlets 1932. The cord stopper 1934 is a fixing unit for fixing the cord 1933 in a state where a length of a portion of the cord 1933 which passes through the cord loop 1931 is shortened.

The cord 1933 can be any as long as it is an elongated member that can be passed through the cord loop 1931, and is not limited to the "cord". For example, the cord 1933 may be a rubber cord made of rubber, a wire made of metal, or the like. A shape or the cord 1933 is not particularly limited, and may be, for example, a flat band.

The "substantially circular" shape is not limited to a circular shape, and includes any shape that can be formed by joining two ends of a curve with each other. Thus, the "substantially circular" includes polygonal shapes such as triangles and rectangles.

The outlet 1932 may not be formed in two places. Both ends of the cord 1933 may be exposed from one outlet 1932.

The cord 1933 may be formed in a substantially annular shape by connecting both ends with each other. In that case, a portion exposed from the outlets 1932 and provided with the cord stopper 1934 is not an end of the cord 1933.

The opening section adjustment mechanism 193 includes two joining parts 1935 at which the cord loop 1931 and the cord 1933 are joined.

The joining part 1935 is formed by joining the cord loop 1931 and the cord 1933 by a method such as sewing in a state where:

the cord 1933 is passed through the cord loop 1931; and the cord loop 1931 extends without stretching or contracting.

The joining parts 1935 are formed at two positions keeping a predetermined distance between them.

The number of positions where the joining parts 1935 are formed is not limited to two.

For example, a further joining part 1935 may be provided at a portion between the joining parts 1935 in FIGS. 3 to 4 (i.e., portion where the outlet 1932 is not formed).

For example, the joining part 1935 may be formed such that the cord loop 1931 and the cord 1933 are joined along a circumferential direction of the cord loop 1931 over a predetermined length. In that case, the cord loop 1931 and the cord 1933 are connected over an entire non-contractible portion 193*a*, which will be described later.

As a result, the portion of the cord loop 1931 between the joining parts 1935 (portion where the outlet 1932 is not formed) is the non-contractible portion 193*a*. In the non-contractible portion 193*a*, the cord loop 1931 cannot be contracted by pulling the cord 1933. The portion between the joining part 1935 and the outlet 1932 is the contractible portion 193*b*. In the contractible portion 193*b*, the cord loop 1931 can be contracted by pulling the cord 1933.

Thus, in the embodiment, the cord loop 1931 and the cord 1933 function as a contraction unit in the present invention. The joining part 1935 functions as an opening creation mechanism and a contraction control mechanism in the present invention.

In the above case where the joining part 1935 is formed such that the cord loop 1931 and the cord 1933 are joined along the circumferential direction of the cord loop 1931 over the predetermined length, the joining part 1935 is a non-contractible portion 193*a*. A portion where the joining part 1935 is not formed is the contractible portion 193*b*. For example, in FIGS. 3 to 4, such configuration is realized in a case where the cord loop 1931 and the cord 1933 are joined over the entire portion between the joining parts 1935 (portion where the outlet 1932 is not formed).

Also in this case, the cord loop 1931 and the cord 1933 function as the contraction unit in the present invention. The joining part 1935 functions as the opening creation mechanism and the contraction control mechanism in the present invention.

In order to facilitate utilization of the opening section of the rope penetration unit 19 as an air outlet, it is required that the opening section remains around the rope R even when the opening section is narrowed to the maximum. In the state where the opening section is narrowed to the maximum, the contractible portion 193*b* of the opening section adjustment mechanism 193 is contracted while the rope R of the full harness type safety belt is passed through the rope passage 192.

Even when the contractible portion 193*b* is contracted to the maximum, the contractible portion 193*b* has a certain length due to overlap of the sheets forming the cord loop 191 as shown in FIG. 4

A size of the opening section in the state where the opening section of the rope penetration unit 19 is narrowed to the maximum by the opening section adjustment mechanism 193 is the sum of:

a length of the non-contractible portion 193*a*; and a length of the contractible portion 193*b* in the fully contracted state.

Thus, the lengths of the non-contractible portion 193*a* and the contractible portion 193*b* are set such that:

the sum of the length of the non-contractible portion 193*a* and the length of the contractible portion 193*b* in the fully contracted state is longer than an outer circumference of the rope R of the full harness type safety belt to be used; and a size of the opening section of the rope penetration unit 19 in the state where the contractible portion 193*b* is fully contracted is within an appropriate range for utilizing it as an air outlet.

Specifically, when the garment body 1 is worn over a full harness type safety belt with a rope R having a peripheral length of about 40 mm, for example, a length of the non-contractible portion 193*a* is 80 mm. A length of the contractible portion 193*b* is 280 mm in a fully stretched state, and is 50 mm in the fully contracted state.

In the above, the cord stopper 1934 is used as the fixing unit. The fixing unit is not limited to this. Any configuration can be adopted as long as the cord 1933 can be fixed in a state where a length of a portion of the cord 1933 passing through the cord loop 1931 is shortened by pulling the cord 1933 and by contracting the contractible portion 193*b* of the cord loop 1931.

The fixing unit may not be provided. For example, the cord 1933 may be fixed in a state where the length of the portion passing through the cord loop 1931 is shortened by binding the cord 1933 itself.

Fan

As shown in FIGS. 1 to 2, the fan 2 is attached to the garment body 1 through the fan mount hole 13. The fan 2 introduces air into space between the garment body 1 and the wearer's body through the fan mount hole 13.

The power source 3 supplies necessary power to the fan 2 through the connection cable 4.

The fan 2 may have any configuration as long as the fan 2 can be attached to the garment body 1 through the fan mount hole 13 to introduce air into the garment body 1.

Power Source

The power source 3 supplies power to the fan 2. For example, a lithium-ion battery with a safety protection circuit is built in the power source 3. The power source 3 is connected to the fan 2 through the connection cable 4.

As long as the power source 3 can supply power to the fan 2, the power source 3 may have any specific configuration.

As shown in FIG. 1, in the embodiment, the power source 3 is put in a pocket as the power source holder 17. However, as described above, a means for holding the power source 3 is not limited to this.

Connection Cable

The connection cable 4 connects the power source 3 with the fan 2. The power source 3 supplies the fan 2 with power required for operating the fan 2 through the connection cable 4.

As shown in FIG. 1, the cable holder 18 holds the connection cable 4 on the inner side of the garment body 1.

The connection cable 4 may have any specific configuration as long as the power source 3 can supply the fan 2 with power required for operating the fan 2.

The fan 2 and the power source 3 may be directly connected without the connection cable 4. Alternatively, the fan 2 and the power source 3 may be integrated.

Advantageous Effect of Embodiment

According to the fan-equipped garment 100 of the embodiment, the rope penetration unit 19 provided in the garment body 1 includes the opening section adjustment mechanism 193. The opening section adjustment mechanism 193 includes the outlet 1932. The cord loop 1931 is substantially annular and has a gap through which the cord can be passed. The cord 1933 longer than the outer circumference of the cord loop 1931 is passed through the cord loop 1931. A cord stopper 1934 is provided at a portion of the cord 1933 which is exposed to the outside from the outlet 1932. Thus, the opening section adjustment mechanism 193 is formed.

The opening section adjustment mechanism 193 includes the joining parts 1935 at two positions. The cord loop 1931 and the cord 1933 are joined at the joining parts 1935. The non-contractible portion 193*a* is formed in the cord loop 1931 between the joining parts 1935. In the non-contractible portion 193*a*, the cord loop 1931 cannot be contracted by pulling the cord 1933. The contractible portion 193*b* is formed between the joining part 1935 and the outlet 1932. In the contractible portion 193*b*, the cord loop 1931 can be contracted by pulling the cord 1933.

In a case where the joining parts 1935 are not provided as in the conventional case, the opening section of the rope penetration unit is closed by pulling both ends of the cord 1933. In this state, the cord stopper 1934 is fixed near the outlet 1932. Thereby, the opening section of the rope penetration unit can be sealed with a rope R of a full harness type safety belt being passed through the opening section. In this case, the rope penetration unit cannot be utilized as an air outlet that discharges air taken in by fans.

On the other hand, when the opening section of the rope penetration unit is opened to the maximum, an opening section is formed in the rope penetration unit. The opening section is large enough to allow a hook provided on the rope R of the full harness type safety belt to pass through the opening section. Therefore, air leakage from the opening section is too large. An amount of air discharged to the outside from the collar air outlet 15 and the sleeve air outlet 16 is insufficient. Cooling effect may be reduced on an upper part, sleeves, etc. of a fan-equipped garment. It is rather undesirable.

In that case, to improve cooling efficiency by utilizing the rope penetration unit as an air outlet, it is necessary to:

pull both ends of the cord 1933 to some extent;

adjust an area of the opening section of the rope penetration unit such that a slight opening section remains around the rope R; and fix the cord stopper 1934 near the outlet 1932 in that state.

It is difficult for wearers of the fan-equipped garment to make such adjustments every time they put it on.

Contrary to this, according to the embodiment, no matter how much both ends of the cord 1933 of the opening section adjustment mechanism 193 are pulled, only the contractible portion 193*b* contracts. A length of the non-contractible portion 193*a* does not change.

Even when the opening section of the rope penetration unit 19 is minimized by the opening section adjustment mechanism 193, the opening section having a certain area remains as shown in FIG. 4. A maker of the fan-equipped garment 100 can predetermine the minimum area of the opening section to a predetermined area. The predetermined area depends on lengths of the non-contractible portion 193*a* and the contractible portion 193*b*.

A wearer of the fan-equipped garment 100 minimizes the opening section of the rope penetration unit 19 by pulling both ends of the cord 1933. The wearer can adjust the area of the opening section of the rope penetration unit 19 only by fixing the cord stopper 1934 near the outlet 1932. The area of the opening section is a predetermined area determined by a maker of the fan-equipped garment 100. The opening section having a slight area remains around the rope R. The area is suitable for utilizing the rope penetration unit as an air outlet. It facilitates utilization of the opening section formed in the rope penetration unit as an air outlet.

Second Embodiment

The fan-equipped garment according to a second embodiment will be described with reference to FIGS. 5 to 6. The configuration other than the rope penetration unit 19A is the same as that of the fan-equipped garment 100 according to the first embodiment. Explanation is omitted.

Configuration of Embodiment

Figure 5:
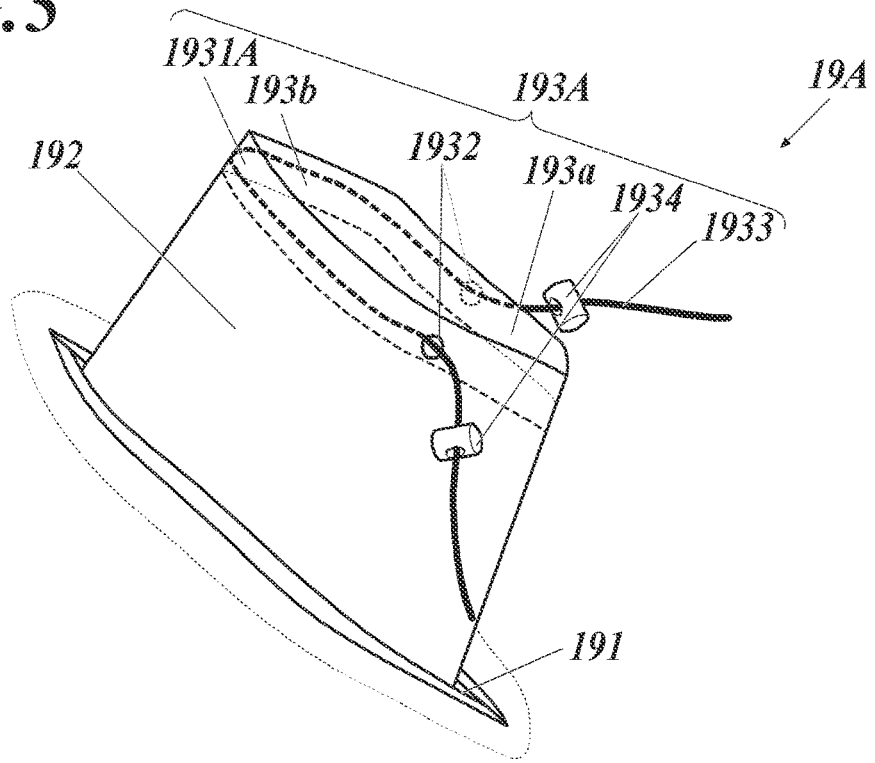
FIG. 5 is a schematic perspective view of the rope penetration unit according to the second embodiment. The contractible portion of the opening section adjustment mechanism is stretched.
Figure 6:
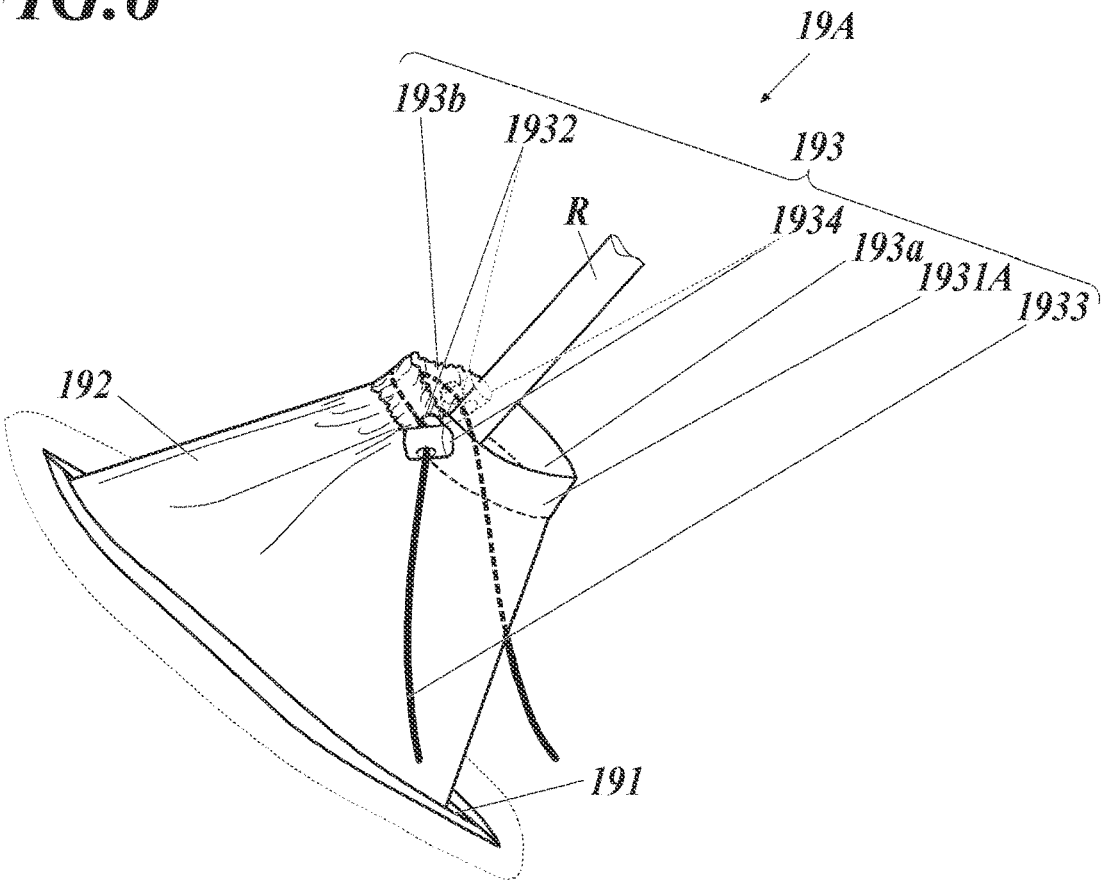
FIG. 6 is a schematic perspective view of the rope penetration unit according to the second embodiment. The contractible portion of the opening section adjustment mechanism is contracted.

As shown in FIGS. 5 to 6, in the opening section adjustment mechanism 193A of the rope penetration unit 19A according to the second embodiment, a cord stopper 1934 is provided at each end of the cord 1933. The two outlets 1932 are close to each other in the first embodiment, and are separated from each other in the second embodiment.

No joining part 1935 is provided. The cord loop 1931A and the cord 1933 are not joined with each other.

As shown in FIG. 6, when both ends of the cord 1933 are pulled, a portion of the cord loop 1931A through which the cord 1933 is passed contracts. A portion through which the cord 1933 is not passed does not contract. In that case, the portion of the cord loop 1931A through which the cord 1933 is passed is the contractible portion 193*b*. The portion through which the cord 1933 is not passed is the non-contractible portion 193*a*.

Thus, in the embodiment, the cord loop 1931A and the cord 1933 function as the contraction unit in the present invention. The portion of the cord loop 1931A through which the cord 1933 is not passed functions as the opening creation mechanism and the contraction control mechanism in the present invention.

Advantageous Effect of Embodiment

According to the opening section adjustment mechanism 193A of the embodiment, as shown in FIG. 6, the rope R of the full harness type safety belt is passed through the opening section of the cord loop 1931A. When both ends of the cord 1933 are pulled in that state, the contractible portion 193*b* through which the cord 1933 is passed through the cord 1931A contracts. The length of the non-contractible portion 193*a* through which the cord 1933 is not passed through the cord loop 1931A does not change.

Therefore, even when the opening section of the rope penetration unit 19A is minimized by the opening section adjustment mechanism 193A, the opening section having a certain area remains as shown in FIG. 6. The opening section having the certain area is surrounded by the non-contractible portion 193*a* and the contractible portion 193*b* which is contracting. A maker of the fan-equipped garment 100 can predetermine the minimum area of the opening section to a predetermined area. The predetermined area depends on lengths of the non-contractible portion 193*a* and the contractible portion 193*b*.

Also in the second embodiment, a wearer of the fan-equipped garment minimizes the opening section of the rope penetration unit 19A by pulling both ends of the cord 1933. The wearer can adjust an area of the opening section of the rope penetration unit 19A only by fixing the cord stopper 1934 near the outlet 1932 in that state. The area of the opening section is a predetermined area determined by a maker of the fan-equipped garment. The opening section having a slight area remains around the rope R. The area is suitable for utilizing the rope penetration unit as an air outlet. Like the first embodiment, it facilitates utilization of the opening section formed in the rope penetration unit as an air outlet.

Third Embodiment

The fan-equipped garment according to a third embodiment will be described with reference to FIGS. 7 to 8. The configuration other than the rope penetration unit 19B is the same as that of the fan-equipped garment 100 according to the first embodiment. Explanation is omitted.

Configuration of Embodiment

Figure 7:
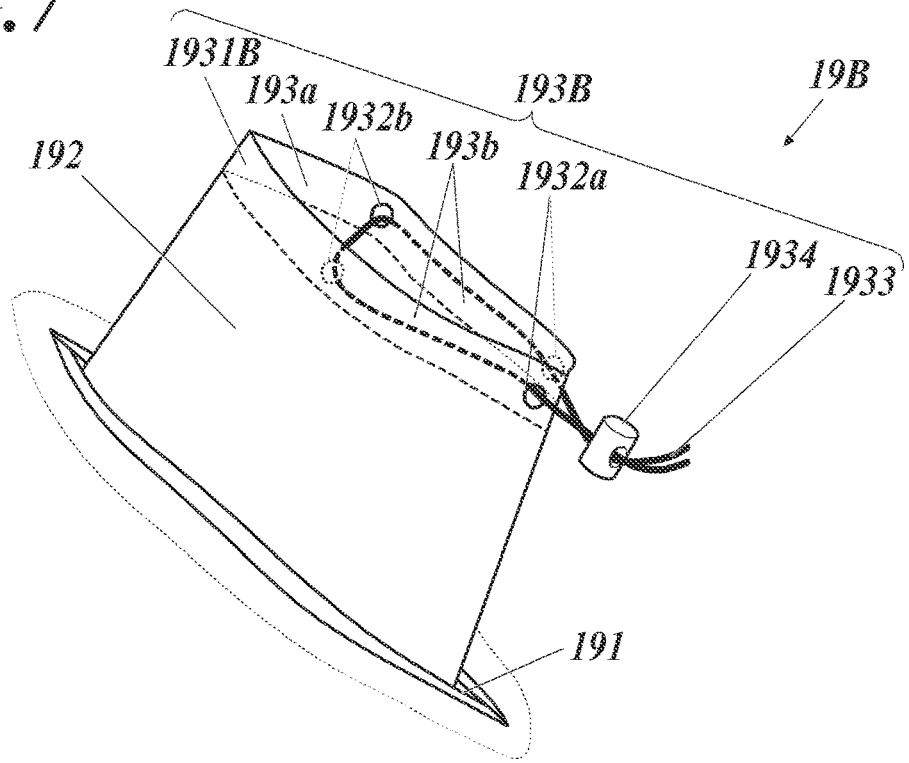
FIG. 7 is a schematic perspective view of the rope penetration unit according to the third embodiment. The contractible portion of the opening section adjustment mechanism is stretched.

As shown in FIG. 7, in the opening section adjustment mechanism 193B of the rope penetration unit 19B according to the third embodiment, outer outlets 1932*a* are provided at two positions on an outer peripheral side of the cord loop 1931B. Inner outlets 1932*b* are provided at two positions on an inner peripheral side of the cord loop 1931A.

No joining part 1935 is provided. The cord loop 1931 and the cord 1933 are not joined with each other.

In this case, as shown in FIG. 7, both ends of the cord 1933 are exposed from the two outer outlets 1932*a*. An intermediate portion of the cord 1933 is exposed from two inner outlets 1932*b* across the opening section of the cord loop 1931B.

Figure 8:
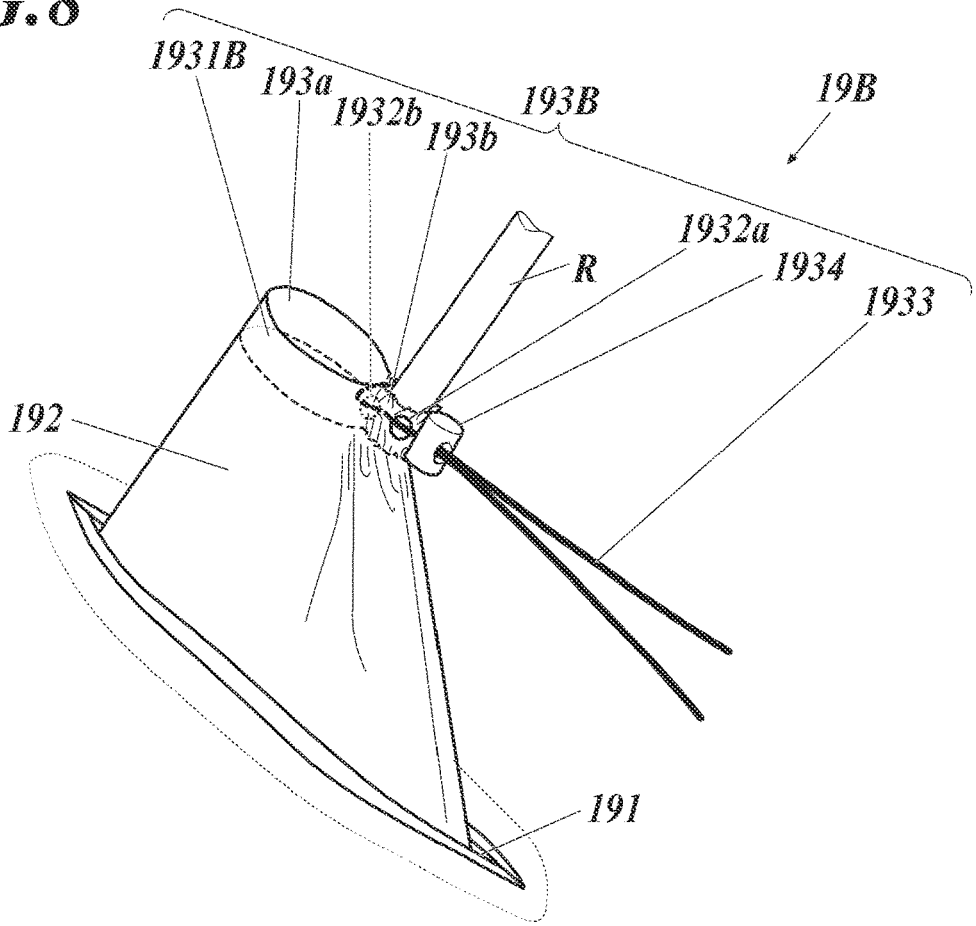
FIG. 8 is a schematic perspective view of the rope penetration unit according to the third embodiment. The contractible portion of the opening section adjustment mechanism is contracted.

As shown in FIG. 8, when both ends of the cord 1933 are pulled, two portions of the cord loop 1931B through which the cord 1933 is passed contract. Each of the two portions is between the outer outlet 1932*a* and the inner outlet 1932*b*. A portion between the inner outlets 1932*b* through which the cord 1933 is not passed does not contract. In this case, the portion of the cord loop 1931B through which the cord 1933 is passed is the contractible portion 193*b*. The portion is between the outer outlet 1932*a* and the inner outlet 1932*b*. The portion of the cord loop 1931B through which the cord 1933 is not passed is the non-contractible portion 193*a*. The portion is between the inner outlets 1932*b*.

Also in the embodiment, the cord loop 1931B and the cord 1933 function as the contraction unit in the present invention. The portion of the cord loop 1931B through which the cord 1933 is not passed functions as the opening creation mechanism and the contraction control mechanism in the present invention. In the present invention, the opening section "around the rope" does not necessarily be the opening section all around the rope. If the opening section remains at a part near the rope as shown in FIG. 8, it is assumed that the opening section remains around the rope.

The case where the opening section adjustment mechanism 193B does not include the joining part 1935 where the cord loop 1931B and the cord 1933 are joined is described above. The joining part 1935 may be provided at two positions near the two inner outlets 1932*b* in FIG. 7 which are slightly closer to the cuter outlets 1932*a*. In that case, the joining part 1935 fixes an exposed portion of the cord 1933 between the inner outlets 1932*b*. It prevents the opening section of the cord loop 1931B from being divided into two at the center as shown in FIG. 8.

Advantageous Effect of Embodiment

In the opening section adjustment mechanism 193B according to the embodiment, the rope R of the full harness type safety belt is passed through the opening section which is formed by the cord loop 1931B and which is surrounded by the cord 1933.

When both ends of the cord 1933 are pulled in this state, the contractible portion 193*b* of the cord loop 1931B through which the cord 1933 is passed contracts as shown in FIG. 8. The non-contractible portion 193*a* of the portion between the inner outlets 1932*b* through which the cord 1933 is not passed does not contract.

Therefore, even when the opening section of the rope penetration unit 19B is minimized by the opening section adjustment mechanism 193B, the opening section having a certain area remains as shown in FIG. 8. The opening section having the certain area is surrounded by the non-contractible portion 193*a*. A maker of the fan-equipped garment 100 can predetermine the minimum area of the opening section to a predetermined area. The predetermined area depends on a length of the non-contractible portion 193*a*.

Also in the third embodiment, a wearer of the fan-equipped garment minimizes the opening section of the rope penetration unit 19B by pulling both ends of the cord 1933. The wearer can adjust an area of the opening section of the rope penetration unit 19B only by fixing the cord stopper 1934 near the outlet 1932*a* in that state. The area of the opening section is a predetermined area determined by a maker of the fan-equipped garment. The opening section having a slight area remains around the rope R. The area is suitable for utilizing the rope penetration unit as an air outlet. Like the first embodiment, it facilitates utilization of the opening section formed in the rope penetration unit as an air outlet.

Fourth Embodiment

The fan-equipped garment according to a fourth embodiment will be described with reference to FIGS. 9 to 10.

The configuration other than the rope penetration unit 19C is the same as that of the fan-equipped garment 100 according to the first embodiment. Explanation is omitted.

Configuration of Embodiment

Figure 9:
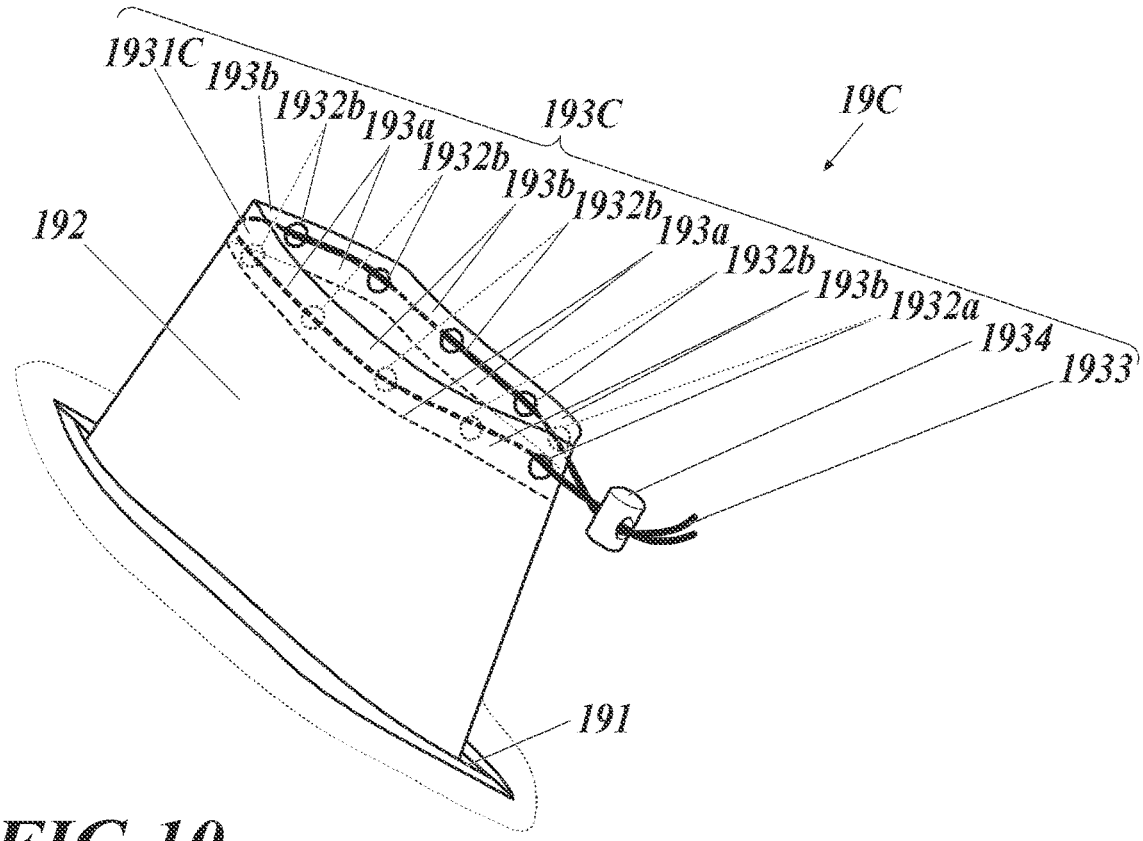
FIG. 9 is a schematic perspective view of the rope penetration unit according to the fourth embodiment. The contractible portion of the opening section adjustment mechanism is stretched.
Figure 10:
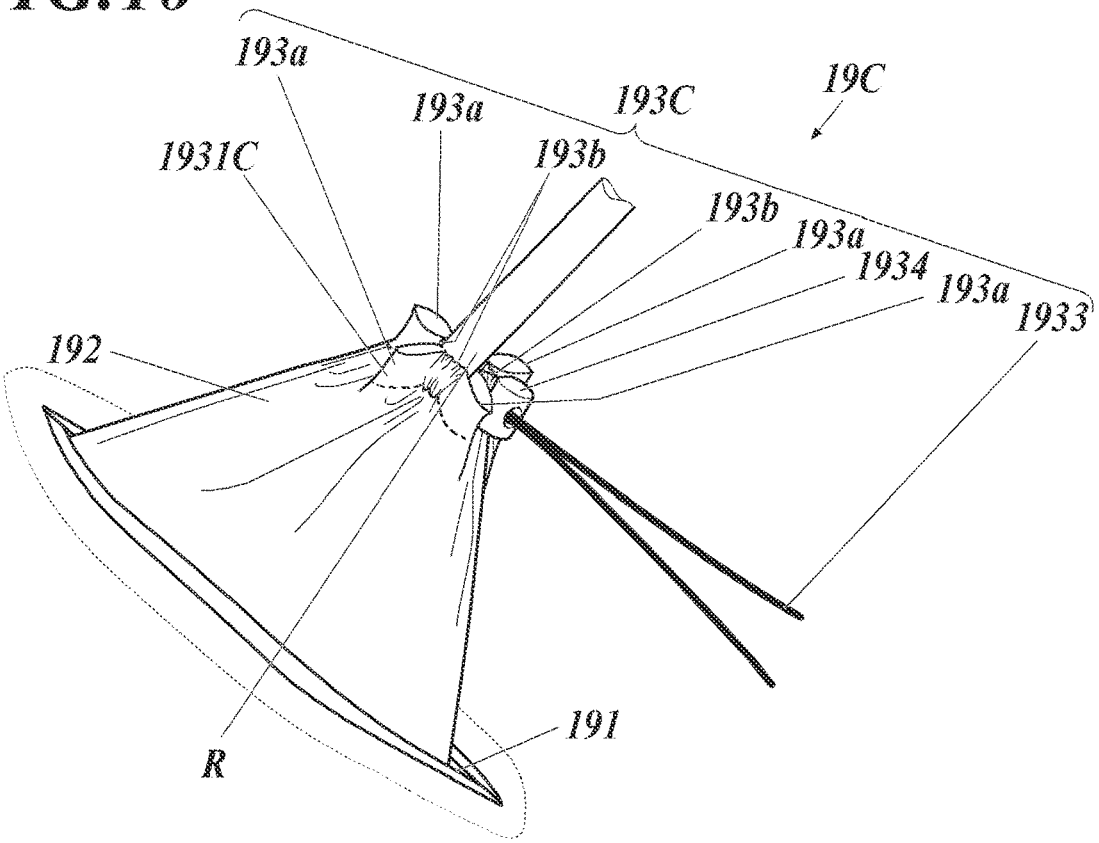
FIG. 10 is a schematic perspective view of the rope penetration unit according to the fourth embodiment. The contractible portion of the opening section adjustment mechanism is contracted.

As shown in FIGS. 9 to 10, in the opening section adjustment mechanism 193C of the rope penetration unit 19C according to the fourth embodiment, the outer outlets 1932*a* are provided at two positions on the outer peripheral side of the cord loop 1931C. The inner outlets 1932*b* are provided at eight positions on the inner peripheral side of the cord loop 1931C.

No joining part 1935 is provided. The cord loop 1931 and the cord 1933 are not joined with each other.

The number of inner outlets 1932*b* is not limited to eight. The inner outlets 1932*b* may be formed at four or more even-numbered positions.

In that case, as shown in FIG. 9, both ends of the cord 1933 are exposed from the two outer outlets 1932*a*. The cord 1933 is passed through the cord loop 1931C such that the portions where the cord 1933 is exposed on the inner peripheral side of the cord 1931C and the portions where the cord 1933 is passed through the cord 1931C are switched at eight inner outlets 1932*b* formed on the inner peripheral side of the cord loop 1931C.

When both ends of the cord 1933 are pulled, the portions of the cord loop 1931C through which the cord 1933 is passed contract as shown in FIG. 10. The portions where the cord 1933 is exposed on the inner peripheral side of the cord loop 1931C do not contract. In this case, the portions of the cord loop 1931C through which the cord 1933 is passed are the contractible portions 193*b*. The portions where the cord 1933 is not passed through the cord loop 1931C and is exposed on the inner peripheral side of the cord loop 1931C is the non-contractible portions 193*a*.

As described above, also in the embodiment, the cord loop 1931C and the cord 1933 function as the contraction unit in the present invention. The portions of the cord loop 1931C through which the cord 1933 is not passed function as the opening creation mechanism and the contraction control mechanism in the present invention.

Advantageous Effect of Embodiment

According to the opening section adjustment mechanism 193C of the embodiment, the rope of the full harness type safety belt is passed through the opening section of the cord loop 1931C as shown in FIG. 1C. The contractible portion 193*b* is contracted by pulling both ends of the cord 1933 in that state. The cord 1933 is exposed on the inner peripheral side of the cord loop 1931C at the non-contractible portions 193*a*. The non-contractible portions 193*a* do not contract and protrude outward.

Therefore, even when the opening section of the rope penetration unit 19C is minimized by the opening section adjustment mechanism 193C, the opening section having a certain area remain at four places as shown in FIG. 10. The opening section having the certain area is surrounded by the non-contractible portions 193*a*. A maker of the fan-equipped garment can predetermine the minimum area of each of the four opening sections to a predetermined area. The predetermined area depends on a length of the non-contractible portion 193*a*.

In the fourth embodiment, a wearer of the fan-equipped garment minimizes the opening section of the rope penetration unit 19C by pulling both ends of the cord 1933. The wearer can adjust an area of the opening section of the rope penetration unit 19C only by fixing the cord stopper 1934 near the outlet 1932*a* in that state. The area of the opening section is a predetermined area determined by a maker of the fan-equipped garment 100. The opening section having a slight area remains around the rope. The area is suitable for utilizing the rope penetration unit as an air outlet. Like the first embodiment, it facilitates utilization of the opening section formed in the rope penetration unit as an air outlet.

Fifth Embodiment

The fan-equipped garment according to a fifth embodiment will be described with reference to FIGS. 11 to 12.

The configuration other than the rope penetration unit 19D is the same as that of the fan-equipped garment 100 according to the first embodiment. Explanation is omitted.

Configuration of Embodiment

Figure 11:
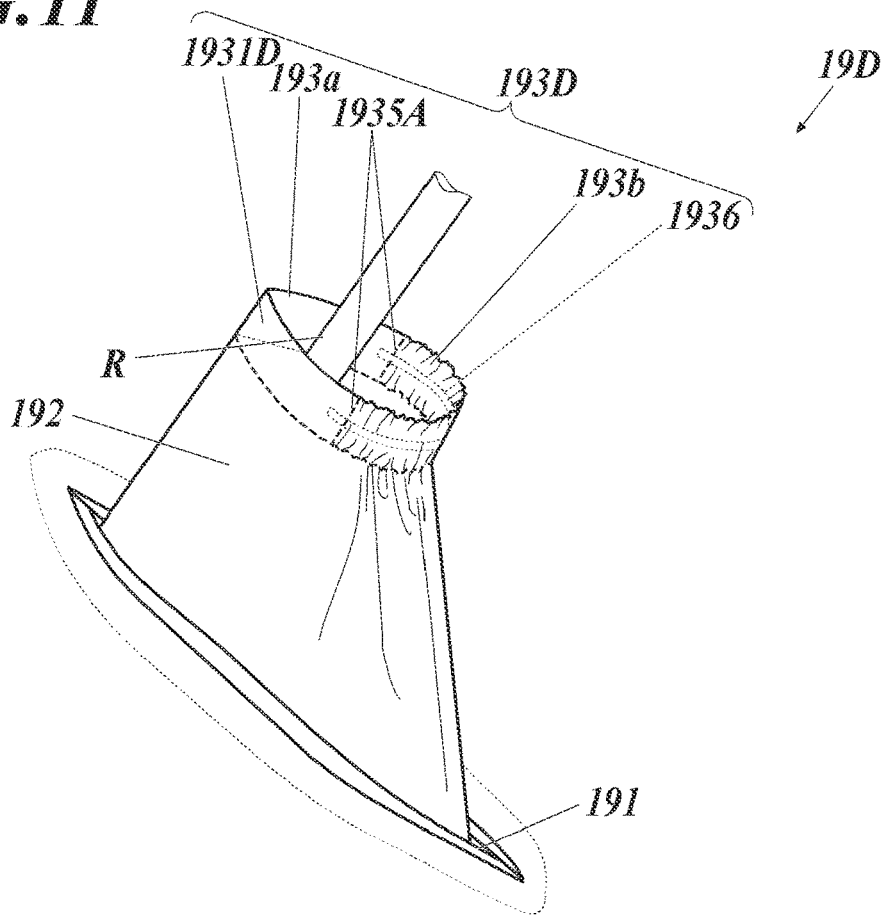
FIG. 11 is a schematic perspective view of the rope penetration unit according to the fifth embodiment. The contractible portion of the opening section adjustment mechanism is contracted.
Figure 12:
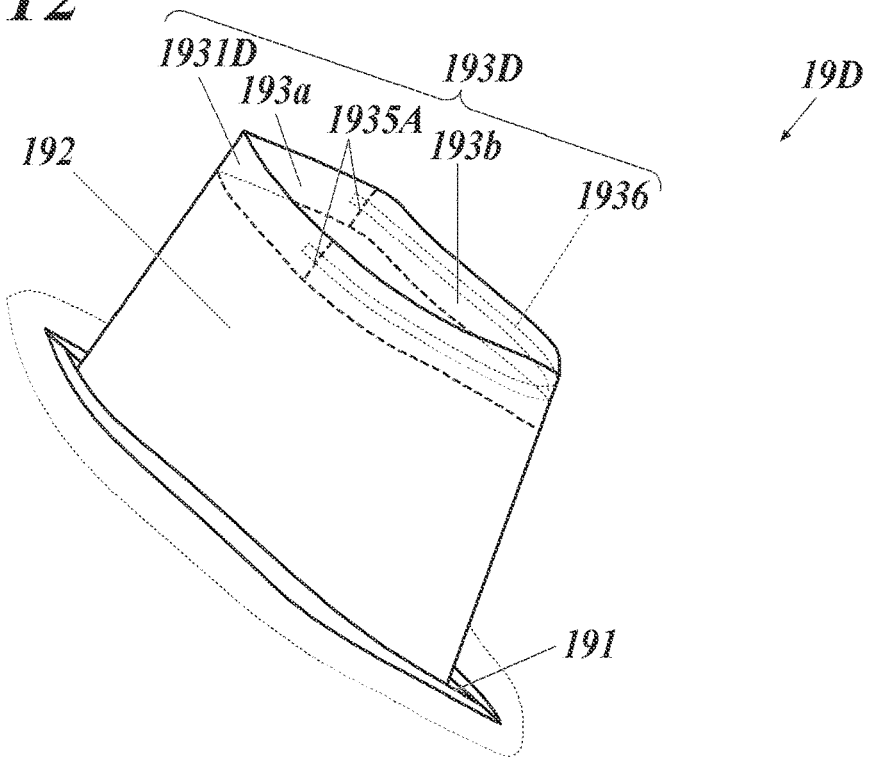
FIG. 12 is a schematic perspective view of the rope penetration unit according to the fifth embodiment. The contractible portion of the opening section adjustment mechanism is stretched.

As shown in FIGS. 11 to 12, the opening section adjustment mechanism 193D of the rope penetration unit 19D according to the fifth embodiment includes a rubber cord 1936 instead of the cord 1933 and the cord stopper 1934. Since the entire rubber cord 1936 is housed in the cord loop 1931D, the outlet 1932 is not provided.

The entire rubber cord 1936 is passed through the cord loop 1931D. The rubber cord 1936 is connected to the cord loop 1931D at the joining part 1935A near both ends of the rubber cord 1936 in a method such as sewing. When the rubber cord 1936 is not stretched, a length of the rubber cord 1936 between the joining parts 1935A is shorter than a length of a portion of the cord loop 1931D through which the rubber cord 1936 is passed between the joining parts 1935A. As shown in FIG. 11, when no force is applied to the rubber cord 1936, the portion of the cord loop 1931D contracts in accordance with the rubber cord 1936 to form the contractible portion 193*b*. Other portion constitutes the non-contractible portion 193*a*.

Thus, in the embodiment, the cord loop 1931D and the rubber cord 1936 function as the contraction unit in the present invention. The non-contractible portion 193*a* functions as the opening creation mechanism and the contraction control mechanism in the present invention. The non-contractible portion 193*a* is a portion of the cord loop 1931D not provided with the rubber cord 1936, that is, a portion that does not contract together with the rubber cord 1936.

The number of positions where the joining parts 1935A are formed is not limited to two.

In one example, the joining part 1935A is further provided between the joining parts 1935A in FIGS. 11 to 12. In another example, the joining part 1935A is formed ail over the rubber cord. The joining part 1935A is joined to the cord loop 1931D all over the rubber cord 1936.

In the embodiment, the rubber cord 1936 is passed through the cord loop 1931D. Alternatively, the cord loop 1931D may not be provided. In that case, the rubber cord 1936 is directly attached to a rim of the opening section at an edge of the rope passage 192 which is opposite to the edge of the rope passage 192 connected to the garment cloth of the garment body.

To wear the fan-equipped garment over the full harness type safety belt, a wearer widens the opening section of the opening section adjustment mechanism 193D by manually stretching the contractible portion 193*b* as shown in FIG. 12. In that state, the wearer passes a hook of the rope R through the opening section. After that, the wearer releases a hand. The rubber cord 1936 contracts, and the contractible portion 193*b* contracts accordingly. A size of the opening section automatically becomes the smallest size that can be adjusted by the rubber cord 1936, as shown in FIG. 11.

Advantageous Effect of Embodiment

According to the opening section adjustment mechanism 193D of the embodiment, even in a state where the opening section of the rope penetration unit 19D is minimized (i.e., a usual state in which no force is applied to the rubber cord 1936), the opening section having a certain area remains as shown in FIG. 11. The opening section is surrounded by the non-contractible portion 193*a* and the contractible portion 193*b* contracted by the rubber cord 1936. A maker of the fan-equipped garment 100 can predetermine the minimum area of the opening section to a predetermined area. The predetermined area depends on lengths of the non-contractible portion 193*a* and the contractible portion 193*b*.

In the fifth embodiment, a wearer of the fan-equipped garment increases a size of the opening section by stretching the contractible portion 193*b*. In that state, the wearer passes a hook through the opening section. The wearer can then adjust an area of the opening section of the rope penetration unit 19D by simply releasing a hand. The area of the opening section is a predetermined area determined by a maker of the fan-equipped garment. The opening section having a slight area remains around the rope. The area is suitable for utilizing the rope penetration unit as an air outlet. Like the first embodiment, it facilitates utilization of the opening section formed in the rope penetration unit as an air outlet.

Sixth Embodiment

The fan-equipped garment according to the sixth embodiment will be described with reference to FIGS. 13 to 14.

The configuration other than the rope penetration unit 19E is the same as that of the fan-equipped garment 100 according to the first embodiment. Explanation is omitted.

Configuration of Embodiment

Figure 13:
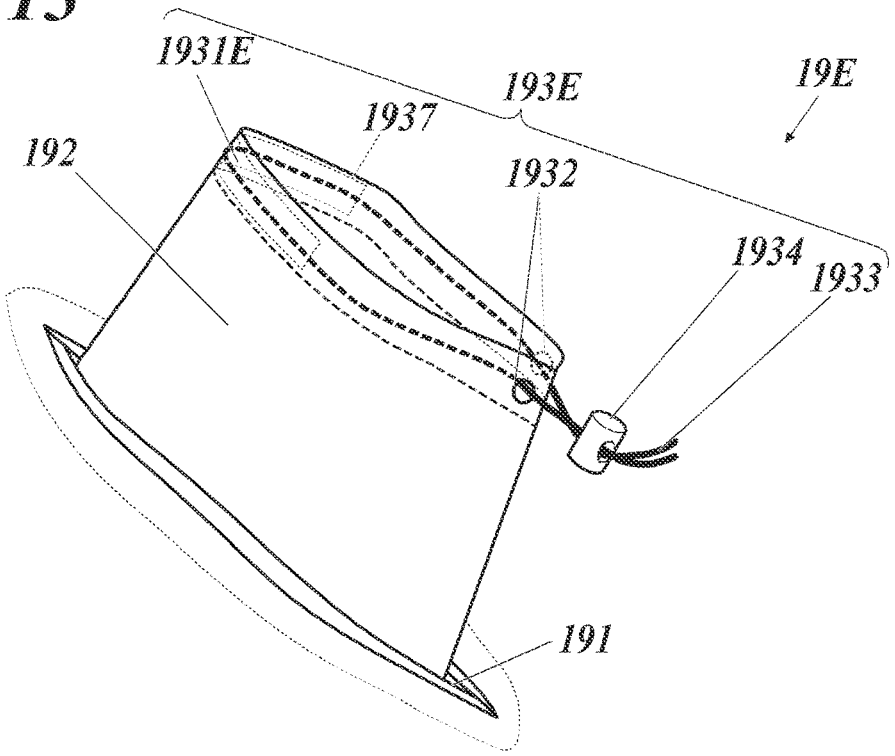
FIG. 13 is a schematic perspective view of the rope penetration unit according to the sixth embodiment. The contractible portion of the opening section adjustment mechanism is stretched.
Figure 14:
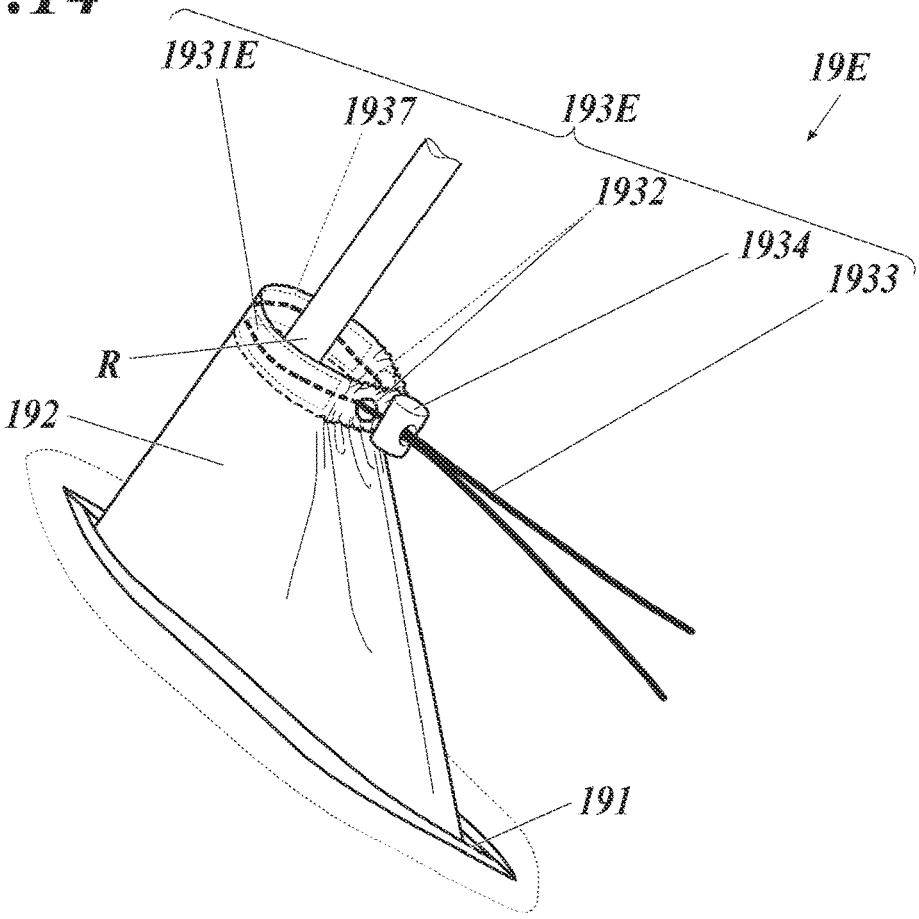
FIG. 14 is a schematic perspective view of the rope penetration unit according to the sixth embodiment. The contractible portion of the opening section adjustment mechanism is contracted.

As shown in FIGS. 13 to 14, the opening section adjustment mechanism 193E of the rope penetration unit 19E according to the sixth embodiment includes a reinforcement member 1937 housed in the cord loop 1931E.

No joining part 1935 is provided. The cord loop 1931E and the cord 1933 are not joined with each other.

The reinforcement member 1937 may be anything as long as:

- the reinforcement member 1937 is an elongated member that can be housed in the cord loop 1931E; and
- the reinforcement member 1937 is strong enough to not contract when the cord loop 1931E is contracted by puling the cord 1933.

For example, a plate made of resin or metal may be used.

As described above, in the embodiment, the cord loop 1931E and the cord 1933 function as the contraction unit in the present invention. The reinforcement member 1937 functions as opening creation mechanism and the contraction control mechanism in the present invention.

The reinforcement member 1937 may be fixed to the cord loop 1931E. The reinforcement member 1937 may not be fixed and may be movable within the cord loop 1931E.

The reinforcement member 1937 does not have to be housed in the cord loop 1931. The reinforcement member 1937 may be fixed to the outside of the cord loop 1931.

Advantageous Effect of Embodiment

According to the opening section adjustment mechanism. 193E of the embodiment, the rope R of the full harness type safety belt is passed through the cord loop 1931E as shown in FIG. 14. Both ends of the cord 1933 are pulled in that state. The cord loop 1931E contracts while, as mentioned above, the reinforcement member 1937 does not contract. A circumference of the opening section of the cord loop 1931E is longer than or equal to a length of the reinforcement member 1937, even when the circumference is at the minimum.

Therefore, even when the opening section of the rope penetration unit 19E is minimized by the opening section adjustment mechanism 193E, the opening section having a certain area remains as shown in FIG. 14. The opening section having the certain area is surrounded by a portion of the cord loop 1931E in which the reinforcement member 1937 is housed. A maker of the fan-equipped garment can predetermine the minimum area of the opening section to a predetermined area. The predetermined area depends on a length of the reinforcement member 1937.

In the sixth embodiment, a wearer of the fan-equipped garment minimizes the opening section of the rope penetration unit 19E by pulling both ends of the cord 1933. The wearer can adjust an area of the opening section of the rope penetration unit 19E only by fixing the cord stopper 1934 near the outlet 1932 in that state. The area of the opening section is a predetermined area determined by a maker of the fan-equipped garment. The opening section having a slight area remains around the rope. The area is suitable for utilizing the rope penetration unit as an air outlet. Like the first embodiment, it facilitates utilization of the opening section formed in the rope penetration unit as an air outlet.

Seventh Embodiment

The fan-equipped garment according to a seventh embodiment will be described with reference to FIGS. 15 to 16.

The configuration other than the rope penetration unit 19F is the same as that of the fan-equipped garment 100 according to the first embodiment. Explanation is omitted.

Configuration of Embodiment

Figure 15:
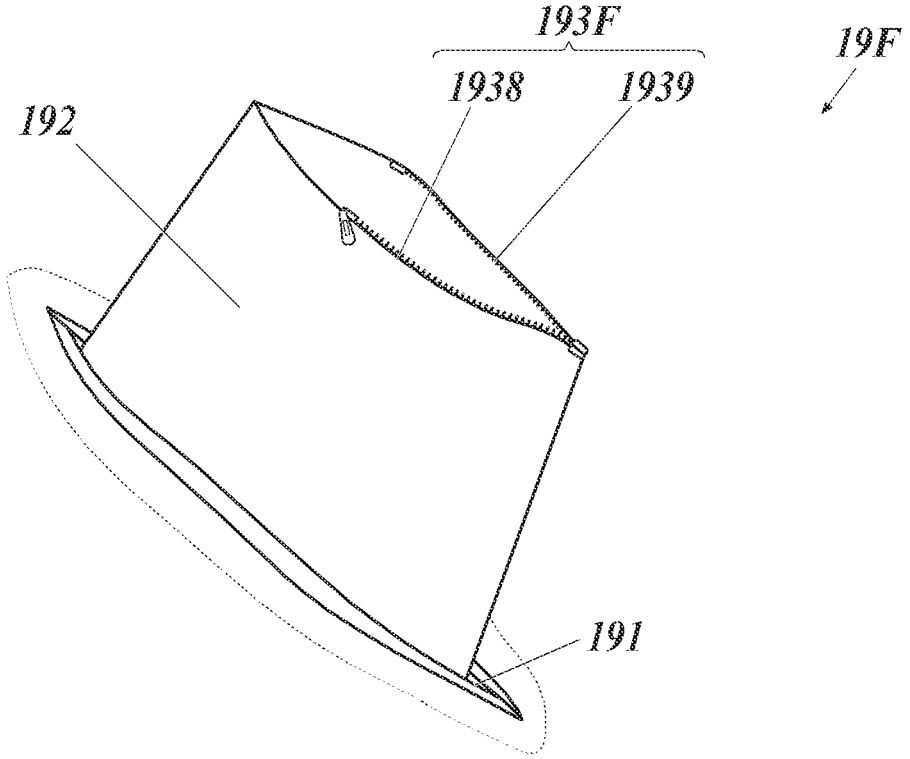
FIG. 15 is a schematic perspective view of the rope penetration unit according to the seventh embodiment. The first connection and the second connection of the opening section adjustment mechanism are not connected with each other.
Figure 16:
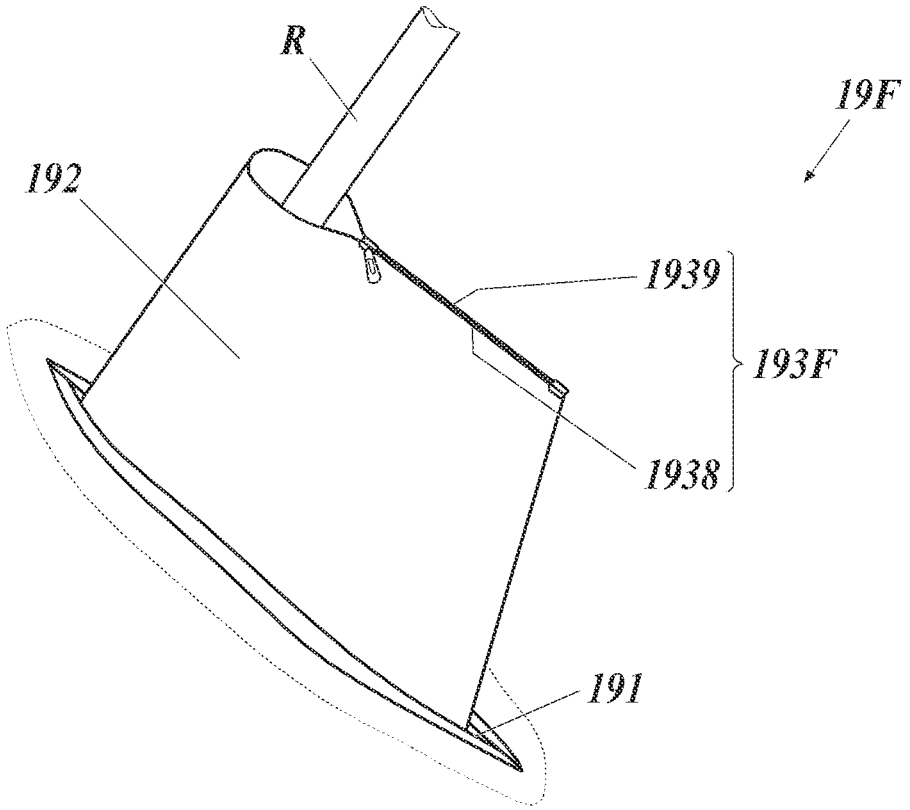
FIG. 16 is a schematic perspective view of the rope penetration unit according to the seventh embodiment. The first connection and the second connection of the opening section adjustment mechanism are connected with each other.

As shown in FIGS. 15 to 16, the opening section adjustment mechanism 193F of the rope penetration unit 19F according to the seventh embodiment is constituted by:

- a first connection 193A formed over a predetermined length along the rim of the opening section of the rope passage 192; and
- a second connection. 1939 formed over a predetermined length along another portion of the rim of the opening section of the rope passage 192, the portion facing the first connection 1938.

The second connection 1939 can be detachably connected to the first connection 1938.

The embodiment does not require any of the cord loop 1931, the outlet 1932, the cord 1933, the cord stopper 1934, and the joining part 1935 in the first embodiment.

For example, as shown in FIGS. 15 to 16, a zipper is used as the first connection 1938 and the second connection 1939. In FIGS. 15 to 16, the first connection 1938 as a general zipper includes a slider of the zipper.

As shown in FIGS. 15 to 16, the first connection 1938 and the second connection 1939 are formed only at a part of the opening section. The opening section is formed at an edge of the rope passage 192 which is opposite to the edge of the rope passage 192 connected to the garment cloth of the garment body. When they are connected, not the entire opening section of the rope passage is closed.

Thus, a part of the rim of the opening section functions as the opening creating mechanism in the present invention. In the part, the first connection 1938 and the second connection

1939 are not provided. The opening section is formed at the edge opposite to the edge of the rope passage 192 connected to the garment cloth of the garment body.

In FIGS. 15 to 16, the first connection 1938 and the second connection 1939 come into contact with each other. When they are connected, only one opening section is formed as shown in FIG. 16. The first connection 1938 and the second connection 1939 are not limited thereto. The first connection 1938 and the second connection 1939 may be formed at separate positions.

In that case, two opening sections are formed when they are connected. At least one of them needs to have an area that is so large that the rope R of the full harness type safety belt can be passed through the opening section.

Advantageous Effect of Embodiment

According to the opening section adjustment mechanism 193F of the embodiment, the rope of the full harness type safety belt is passed through the rope passage 192 as shown in FIG. 16. A size of the opening section of the rope passage 192 can be reduced to a predetermined size by connecting the first connection 1938 and the second connection 1939 in that state. The predetermined size depends on a length of the portion not provided with the first connection 1938 and the second connection 1939. The opening section cannot be made smaller.

Therefore, even when the opening section of the rope penetration unit 19F is minimized by the opening section adjustment mechanism 193F, the opening section having a certain area remains in the rope passage 192 as shown in FIG. 16. The opening section having the certain area corresponds to a length of a part of an edge of the rope passage 192 where the first connection 1938 and the second connection 1939 are not formed. The edge is opposite to the edge of the rope passage 192 connected to the garment cloth of the garment body. A maker of the fan-equipped garment can predetermine the minimum area of the opening section to a predetermined area. The predetermined area depends on a length of the above part.

In the seventh embodiment, a wearer of the fan-equipped garment can adjust an area of the opening section of the rope penetration unit 19F only by fully connecting the first connection 1938 and the second connection 1939. The area of the opening section is a predetermined area determined by a maker of the fan-equipped garment. The opening section having a slight area remains around the rope. The area is suitable for utilizing the rope penetration unit as an air outlet. Like the first embodiment, it facilitates utilization of the opening section formed in the rope penetration unit as an air outlet.

Modification

The first connection and the second connection may be any as long as a part around the opening section can be connected over a predetermined length. The opening section is at the edge opposite to the edge of the rope passage 192 which is connected to the garment cloth of the garment body. The specific configuration of the first connection and the second connection is not limited to the zipper.

Figure 17:
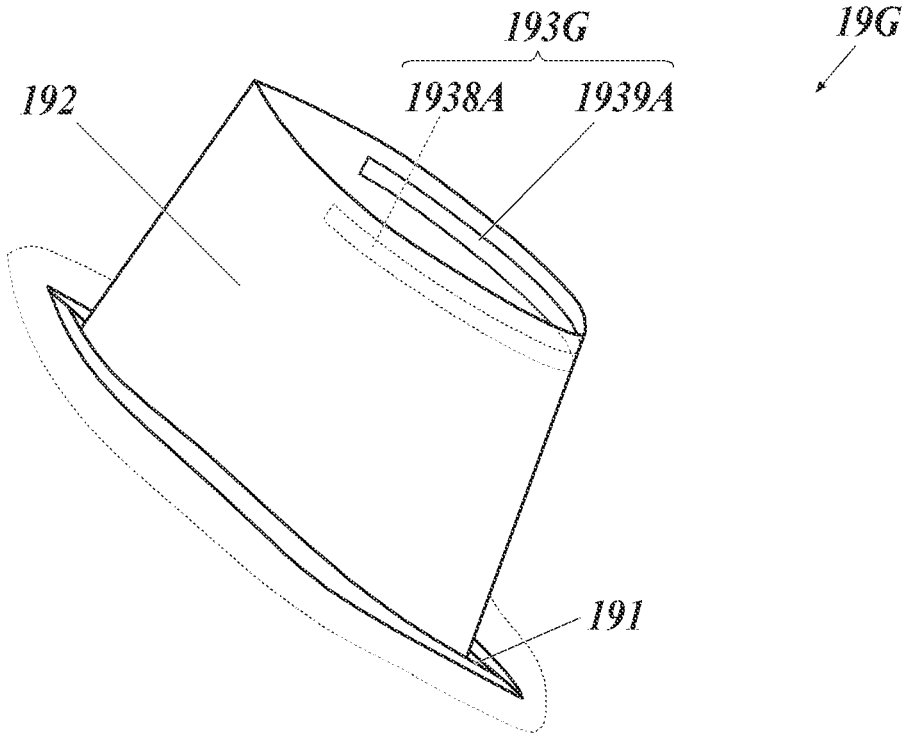
FIG. 17 is a schematic perspective view of the rope penetration unit according to a modification of the seventh embodiment. The first connection and the second connection of the opening section adjustment mechanism are not connected with each other.
Figure 18:
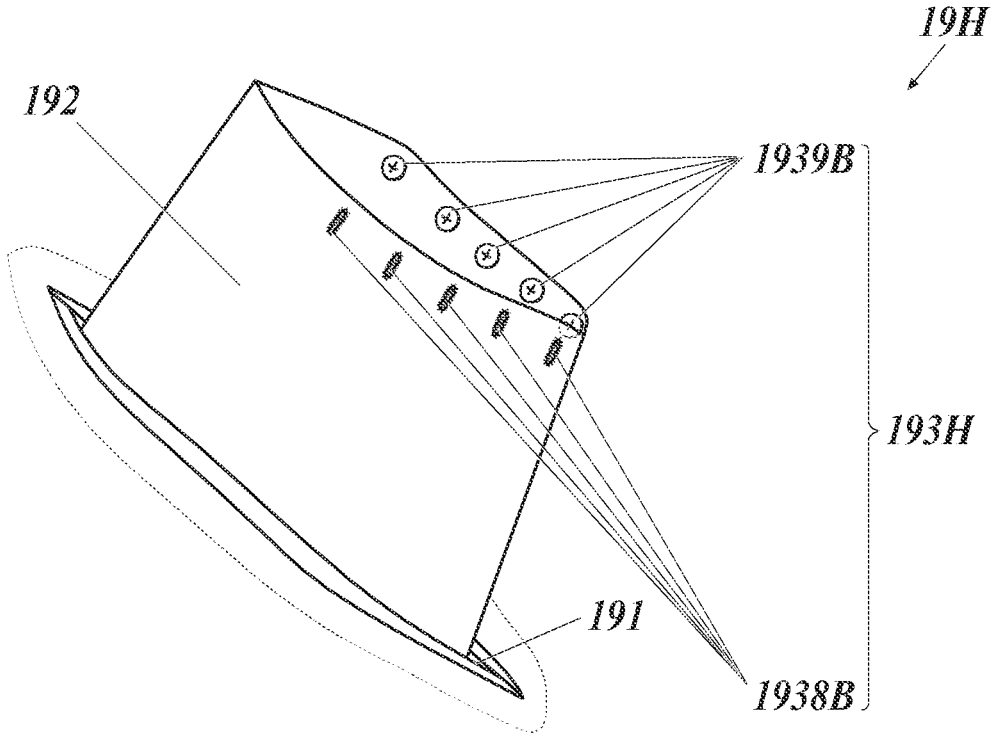
FIG. 18 is a schematic perspective view of the rope penetration unit according to a modification of the seventh embodiment. The first connection and the second connection of the opening section adjustment mechanism are not connected with each other.

For example, like the opening section adjustment mechanism 193G shown in FIG. 17, a hook-and-loop fastener may be provided around the edge as the first connection 1938A and the second connection 1939A, the edge being opposite the edge of the rope passage 192 which is connected to the predetermined length. Alternatively, like the opening section adjustment mechanism 193H shown in FIG. 18, buttons and button holes may be arranged around the edge as the first connection 1938B and the second connection 1939B, the edge being opposite to the edge of the rope passage 192 which is connected to the garment body. The buttons and button holes line up along the opening section of the rope passage 192.

INDUSTRIAL APPLICABILITY

Since the present invention is configured as described above, the present invention can be utilized as an opening section adjustment mechanism, a garment body of a fan-equipped garment, and a fan-equipped garment which facilitate utilization of an opening through which a rope is passed as an air outlet.

REFERENCE SIGNS LIST

100 fan-equipped garment
1 garment body
13 fan mount hole (mount hole)
19, 19A, 19B, 19C, 19D, 19E, 19F, 191G, 19H rope penetration unit
193, 193A, 193B, 193C, 193D, 193E, 193F, 193G, 193H opening section adjustment mechanism
1931, 1931A, 1931B, 1931C, 1931D, 1931E cord loop
1932 outlet
1932*a* outer outlet
1932*b* inner outlet
1933 cord
1934 cord stopper (fixing unit)
1935, 1935A joining part
1936 rubber cord
1937 reinforcement member
1938 first connection
1939 second connection
193*a* non-contractible portion
193*b* contractible portion
120 fan (ventilator)
130 power source
140 connection cable (power source)
R rope

The invention claimed is:

1. A garment body of a fan-equipped garment which is formed in a shape that is configured to cover at least a trunk of a wearer and which is made of garment cloth that is not breathable or has sufficient breathability to be inflated by a ventilator that introduces air, the garment body comprising:
- a mount hole for mounting the ventilator; and
- a rope penetration unit through which a rope penetrates from an inside to an outside of the garment body of the fan-equipped garment, wherein:
- the rope penetration unit comprises an opening section adjustment mechanism that adjusts an opening area of an opening section,
- the opening section adjustment mechanism comprises:
  - a contraction unit that contracts a rim of the opening section, the contraction unit including:
    - a cord loop which extends along the rim of the opening section and which has a gap that communicates with an outside at an outlet; and
    - a cord provided around an entirety of the rim of the opening section and through the cord loop such that a part of the cord is exposed from the outlet; and a contraction control mechanism that suppresses contraction of the cord rim of the opening section by the contraction unit, the contraction control mechanism comprises at least two joining parts at each of which the cord loop and the cord are joined, and the joining parts are provided at positions between respective ends of the cord and suppress contraction of a portion of the cord loop between the joining parts where the outlet is not formed such that even when the opening area of the opening section is adjusted to its minimum area by the cord loop being brought to its most contracted position, the portion of the cord loop between the joining parts is not contracted.

2. The opening section adjustment mechanism according to claim 1, wherein:

along the rim of the opening section, the contraction unit comprises:

a passage where the cord is passed through the cord loop; and a non-passage where the cord is not passed through the cord loop.

3. The opening section adjustment mechanism according to claim 2, wherein the cord loop comprises at least two outlets formed with a predetermined interval.

4. The opening section adjustment mechanism according to claim 3, wherein the outlets comprise an outer outlet formed on an outer peripheral side of the cord loop.

5. The opening section adjustment mechanism according to claim 1, further comprising:

a fixing unit that fixes the contraction unit in a contracted state.

6. A fan-equipped garment, comprising:

the garment body of the fan-equipped garment according to claim 1;

the ventilator that introduces air inside the garment body of the fan-equipped garment; and a power source that supplies power to the ventilator.

* * * * *